US010794608B2

(12) United States Patent
Motodani et al.

(10) Patent No.: US 10,794,608 B2
(45) Date of Patent: Oct. 6, 2020

(54) AIR-CONDITIONING CONTROL EVALUATION APPARATUS, AIR-CONDITIONING CONTROL EVALUATION METHOD, AND COMPUTER READABLE MEDIUM

(71) Applicant: Mitsubishi Electric Corporation, Chiyoda-ku (JP)

(72) Inventors: Mio Motodani, Chiyoda-ku (JP); Masae Sawada, Chiyoda-ku (JP); Takaya Yamamoto, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 270 days.

(21) Appl. No.: 16/066,422

(22) PCT Filed: Jul. 7, 2016

(86) PCT No.: PCT/JP2016/070063
§ 371 (c)(1),
(2) Date: Jun. 27, 2018

(87) PCT Pub. No.: WO2017/134847
PCT Pub. Date: Aug. 10, 2017

(65) Prior Publication Data

US 2019/0017721 A1 Jan. 17, 2019

(30) Foreign Application Priority Data

Feb. 4, 2016 (JP) ..... 2016-020029

(51) Int. Cl.
*F24F 11/49* (2018.01)
*F24F 11/46* (2018.01)
(Continued)

(52) U.S. Cl.
CPC ..... *F24F 11/49* (2018.01); *F24F 11/46* (2018.01); *F24F 11/63* (2018.01); *F24F 11/64* (2018.01);
(Continued)

(58) Field of Classification Search
USPC ..... 702/183
See application file for complete search history.

(56) References Cited

U.S. PATENT DOCUMENTS 5,335,180 A 8/1994 Takahashi et al.
2014/0365017 A1* 12/2014 Hanna ..... F24F 11/30 700/276

(Continued)

FOREIGN PATENT DOCUMENTS

JP 05-006500 A 1/1993
JP 3743247 B2 2/2006
JP 2012-242067 A 12/2012

OTHER PUBLICATIONS

International Search Report dated Aug. 9, 2016 in PCT/JP2016/070063, filed on Jul. 7, 2016.

*Primary Examiner* — Paul D Lee
(74) *Attorney, Agent, or Firm* — Xsensus LLP

(57) ABSTRACT

An air-conditioning control evaluation apparatus includes a storage unit and a computing unit. The storage unit stores building information, input information, control information, a set of building models, and a candidate selection criterion. The computing unit determines an item available as input data for a building model, identifies the distribution of observed data, selects a plurality of candidate building models from the set of building models based on the available item and candidate selection criterion, estimates each parameter based on a method corresponding to the distribution, determines one building model based on a predetermined statistic calculated for the plurality of build-
(Continued)

ing models and the residual between estimated and observed values calculated for each of the building models, and evaluates, by use of the determined building model, energy saving and comfort for a plurality of controls to be evaluated.

13 Claims, 13 Drawing Sheets

(51) Int. Cl.

| | |
|---|---|
| ***F24F 11/64*** | (2018.01) |
| ***F24F 11/89*** | (2018.01) |
| ***F24F 11/63*** | (2018.01) |
| *F24F 110/22* | (2018.01) |
| *F24F 110/20* | (2018.01) |
| *F24F 110/10* | (2018.01) |
| *F24F 110/12* | (2018.01) |

(52) U.S. Cl.
CPC ..... *F24F 11/89* (2018.01); *F24F 2110/10* (2018.01); *F24F 2110/12* (2018.01); *F24F 2110/20* (2018.01); *F24F 2110/22* (2018.01)

(56) References Cited

U.S. PATENT DOCUMENTS

2015/0057810 A1* 2/2015 Smith ..... G05B 13/024 700/276
2015/0178865 A1* 6/2015 Anderson ..... G05B 17/02 705/7.25
2015/0370927 A1* 12/2015 Flaherty ..... F24F 11/30 703/1
2016/0054018 A1* 2/2016 Motodani ..... F24F 11/56 700/276
2016/0305678 A1* 10/2016 Pavlovski ..... F24F 11/62
2017/0051935 A1* 2/2017 Lee ..... F24F 11/30
2017/0211830 A1* 7/2017 Kosaka ..... G05B 19/048

* cited by examiner

FIG. 7A
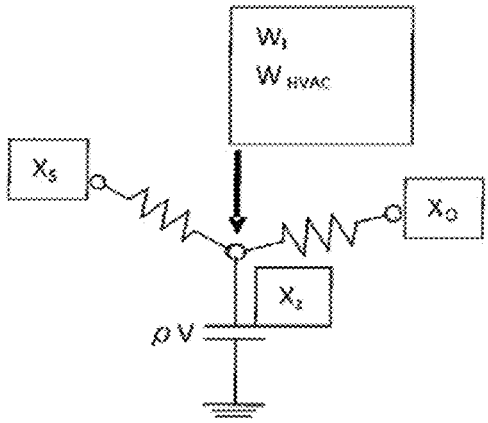
FIG. 7B
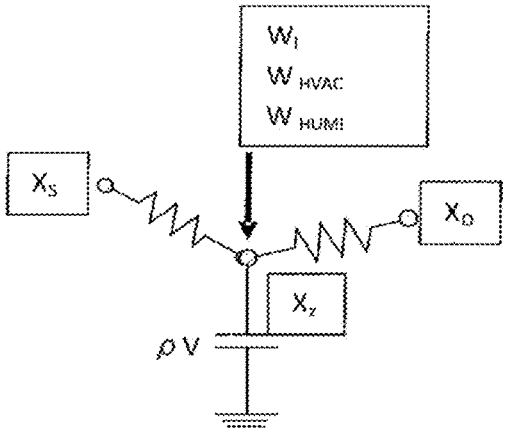
FIG. 8
| MODEL | LOGARITHMIC LIKELIHOOD | p-VALUE |
|---|---|---|
| A | −4121 | $<10^{-18}$ |
| B | −274 | $<10^{-18}$ |
| C | −6.4 | 0.011 |
| D | −0.17 | 0.68 |

AIR-CONDITIONING CONTROL EVALUATION APPARATUS, AIR-CONDITIONING CONTROL EVALUATION METHOD, AND COMPUTER READABLE MEDIUM

TECHNICAL FIELD

The present invention relates to an air-conditioning control evaluation apparatus that evaluate a control to be executed for an air-conditioning related device, an air-conditioning system, an air-conditioning control evaluation method, and a program for causing a computer to execute the air-conditioning control evaluation method.

BACKGROUND ART

Recent years have seen increasing energy-saving demands for various air-conditioning related devices constituting air-conditioning systems disposed in, for example, buildings. To meet such demands, a number of energy-saving control methods have been proposed to reduce the power consumption of air-conditioning related devices. Current approaches to energy saving do not focus solely on improving the performance of each individual air-conditioning related device but also demand, for example, use of a building energy management system (BEMS) or other systems to achieve energy saving in terms of operation or management of building equipment and facilities. To achieve energy saving using systems such as BEMS, it is inadequate to simply improve the operational efficiency of air-conditioning related devices of individual tenants in a building. Rather, it is essential to promote energy saving at least in cooperation with users such as the building's administrator and manager.

In proposing a new air-conditioning system aimed at energy saving to a user, or in proposing a user to introduce an energy-saving control into an existing air-conditioning system, it is necessary to present the user with an expected energy saving effect. Desirably, the effect presented to the user in this case is not an expected effect for buildings in general but an expected effect corresponding to the particular building actually managed by that user.

Patent Literature 1 discloses an exemplary technique with which, for a cooling energy apparatus that controls the temperature of a predetermined space within a building, an energy-saving effect is calculated by taking the thermal load of the space into account.

An energy consumption calculating apparatus disclosed in Patent Literature 1 includes a first thermal load analysis unit, and a first power consumption estimation unit. The first thermal load analysis unit determines the thermal load of a space by use of a physical model having the following pieces of information as input information: building information, information on heat-generating element, environmental information, and operational information. The first power consumption estimation unit estimates, based on cooling-energy-apparatus characteristics that associate thermal load with the power consumption of a cooling energy apparatus, a power consumption corresponding to the thermal load determined by the first thermal load analysis unit.

Patent Literature 1 also discloses that the energy consumption calculating apparatus includes a statistical analysis unit that determines the characteristics of the cooling energy apparatus by use of a statistical model (for example, a simple regression analysis or a multiple regression analysis) that statistically associates a set of past thermal load data with a set of actual power consumption data.

The invention disclosed in Patent Literature 1 employs the above-mentioned configuration to analyze the thermal load of a space by use of a physical model, and estimate power consumption based on cooling-energy-apparatus characteristics that associate thermal load with power consumption. This helps minimize the number of parameters in comparison to existing simulation techniques.

Patent Literature 1 discloses an exemplary method that analyzes, in advance, the degree to which input data influences the output data to be estimated, and integrates this information into a computation model. Specifically, Patent Literature 1 discloses an approach that involves determining, by use of a simple regression model or a multiple regression model as a statistical model, cooling-energy-apparatus characteristics with thermal load as input and power consumption as output, and using the cooling-energy-apparatus characteristics for a physical model.

Although not directed to evaluation of an air-conditioning control executed for a space within a building, Patent Literature 2 and Patent Literature 3 disclose exemplary methods for determining, for the purpose of obtaining an estimate for a quantity to be evaluated, a computation model suited for the evaluated quantity and the minimum appropriate parameters. According to this method, such a calculation model and parameters are selected based on the error between observed and estimated values.

Patent Literature 2 discloses an apparatus that uses a neural network to predict future sales and shipping demands for a product from time-series data such as the actual sales and shipment data on the product. Patent Literature 2 discloses an approach that involves processing existing data to generate time-series actual data each time new actual data is input, analyzing the generated time-series actual data to select the best learning model as a prediction model from a plurality of learning models, and inputting the latest actual data used for prediction into the prediction model to compute a prediction. The disclosed approach further involves, when creating new actual data by processing existing data, selecting input data for the neural network by using a correlation coefficient between a set of actual data serving as input data and the time-series actual value of the output data to be estimated.

Patent Literature 3 discloses a system that controls the state of a facility of interest, which is a facility subject to movement of moving objects, based on information indicative of the state of the facility. Patent Literature 3 discloses an approach involving generating a prediction model that models information such as the pattern of the number of moving objects at a measurement point with respect to date and time, determining an error in the observed value of the model in correspondence with changes of moving objects with the elapse of time, and correcting the model based on the results of the determination.

CITATION LIST

Patent Literature

Patent Literature 1: Japanese Unexamined Patent Application Publication No. 2012-242067

Patent Literature 2: Japanese Patent No. 3743247

Patent Literature 3: Japanese Unexamined Patent Application Publication No. 05-6500

SUMMARY OF INVENTION

Technical Problem

The system disclosed in Patent Literature 1 uses predetermined physical and statistical models to calculate how much thermal load and power consumption increase or decrease due to changes in the operation of the cooling energy apparatus. In this case, the models to be used for the calculation need to be determined in advance from among models representing different patterns for different types of business. In determining thermal load by use of a physical model, it is desirable to change the physical mode in accordance with factors such as the building's geometry and structure as well as the location of sensor placement and available data items. In this regard, the ability to automatically select a model that most accurately represents reality is desired. The above-mentioned system does not consider how the comfort of a space changes with changing operation of the cooling energy apparatus. For instance, a case is considered where a control is performed to achieve energy saving by raising the temperature of refrigerant passing through the evaporator during cooling. Such a control results in decreased rate of dehumidification of the air passing through the evaporator, causing indoor humidity to vary. For indoor humidity variation as well, as with thermal load or room temperature, it is desirable to automatically select an optimal model from a plurality of physical models.

For the system disclosed in Patent Literature 1, it would be also conceivable to employ the method disclosed in each of Patent Literatures 2 and 3 in estimating changes in the thermal load and power consumption of the cooling energy apparatus.

In accordance with the method disclosed in Patent Literature 2, for input and output data for which it is difficult to define a physical model, the correlation coefficient between the input and output data is used in selecting input data. If it is desired to use unavailable data as input and output data, however, it is difficult to select an optimal model based on a simple correlation alone. For instance, a case is considered where wall surface temperature is used in evaluating comfort. In this case, wall surface temperature is unavailable as input and output data but can be predicted by defining a physical model. For the apparatus disclosed in Patent Literature 2, while no correlation is observed for the input and output data used in learning a prediction model, the apparatus does not include a criterion for selecting a physical model of a building estimated from information such as data desired to be used for evaluation and the specifications of the building. Thus, it is not possible to select an optimal model, and the accuracy of prediction can potentially deteriorate.

In accordance with the method disclosed in Patent Literature 3, the evaluation criterion relies solely on the error between estimated and observed values. This may unnecessarily increase the complexity of the computation model, potentially resulting in increased number of parameters to be estimated and deteriorated accuracy of output data estimation.

The present invention has been made to address the above-mentioned problems, and provides an air-conditioning control evaluation apparatus, an air-conditioning system, an air-conditioning control evaluation method, and a program for causing a computer to execute the air-conditioning control evaluation method. The provided apparatus, system, method, and program make it possible to automatically select, from among a plurality of building models, a building model that minimizes the number of parameters necessary for estimating variation of power consumption of an air-conditioning related device and changes in indoor comfort, and best represents the thermal characteristics of a building where the air-conditioning related device is disposed or both the thermal and humidity characteristics of the building, thus enabling evaluation of energy saving and indoor comfort for an air-conditioning control to be evaluated.

Solution to Problem

According to an embodiment of the present invention, there is provided an air-conditioning control evaluation apparatus that evaluates a plurality of evaluated controls to be evaluated for at least one air-conditioning related device disposed within a building, the air-conditioning control evaluation apparatus including a storage unit to store building information on a building that includes an area where the air-conditioning related device is disposed, device information including characteristics of the air-conditioning related device, observed data including information on an operational state of the air-conditioning related device, and information on temperatures of the area and outside air, or information on both temperatures and humidities of the area and outside air, control information on an evaluated control to be executed for the air-conditioning related device, a set of building models including a plurality of building models, the plurality of building models representing thermal characteristics of the building or both thermal characteristics and humidity characteristics of the building, and a candidate-model selection criterion representing a correspondence between a building model, and items included in each of the building information, the device information, and the observed data, a data evaluation unit to determine an item available as input data for the building model from among the items included in each of the building information, the device information, and the observed data, and identify a type of distribution of the observed data, a candidate-model selection unit to select, based on the item available as the input data and the candidate-model selection criterion, a plurality of candidate building models from the set of building models, a parameter estimation unit to determine a parameter estimation method in correspondence with the type of distribution, and calculate, in accordance with the parameter estimation method, an estimated value for a parameter included in the plurality of selected candidate building models, a model evaluation unit to calculate a predetermined statistic on the plurality of selected candidate building models, and determine, based on the statistic and a residual calculated for each of the plurality of selected candidate building models, one building model from the plurality of selected candidate building models, the residual being a residual between estimated and observed values of temperature or a residual between estimated and observed values of both temperature and humidity, and an air-conditioning control evaluation unit to calculate, by using the building model determined by the model evaluation unit, an energy-saving evaluation value and a comfort evaluation value for the air-conditioning related device that result if each of the plurality of evaluated controls is executed.

According to an embodiment of the present invention, there is provided an air-conditioning system including at least one air-conditioning related device disposed within a building, an air-conditioning controller to control the air-conditioning related device, and the air-conditioning control evaluation apparatus according to an embodiment of the present invention.

According to an embodiment of the present invention, there is provided an air-conditioning control evaluation method executed by a computer, the computer evaluating a plurality of evaluated controls to be evaluated for at least one air-conditioning related device disposed within a building, the air-conditioning control evaluation method including storing, in a storage unit of the computer, building information on a building that includes an area where the air-conditioning related device is disposed, device information including characteristics of the air-conditioning related device, observed data including information on an operational state of the air-conditioning related device, and information on a temperature of the area, or information on both a temperature and a humidity of the area, control information on an evaluated control to be executed for the air-conditioning related device, a set of building models representing thermal characteristics of the building or both thermal characteristics and humidity characteristics of the building, the set of building models including a thermal characteristic model that includes at least outside air temperature and indoor heat generation rate as factors influencing thermal characteristics, the thermal characteristic model including a thermal characteristic model that includes a parameter representing heat insulation performance of a frame of the building, and a thermal characteristic model that includes a parameter representing heat insulation performance and heat storage performance of the frame of the building, a candidate-model selection criterion representing a correspondence between a building model, and items included in each of the building information, the device information, and the observed data, determining an item available as input data for the building model from among the items included in each of the building information, the device information, and the observed data, and identifying a type of distribution of the observed data, selecting, based on the item available as the input data and the candidate-model selection criterion, a plurality of candidate building models from the set of building models, determining a parameter estimation method in correspondence with the type of distribution, and calculating, in accordance with the parameter estimation method, an estimated value for a parameter included in the plurality of selected candidate building models, calculating a predetermined statistic on the plurality of selected candidate building models, and determining, based on the statistic and a residual calculated for each of the plurality of selected candidate building models, one building model from the plurality of selected candidate building models, the residual being a residual between estimated and observed values of temperature or a residual between estimated and observed values of both temperature and humidity, and calculating, by using the determined building model, power consumption and a comfort evaluation value for the air-conditioning related device that result if each of the plurality of evaluated controls is executed.

According to an embodiment of the present invention, there is provided a program for causing a computer to execute a process, the process including storing, in a storage unit of the computer, building information on a building that includes an area where at least one air-conditioning related device disposed within a building is located, device information including characteristics of the air-conditioning related device, observed data including information on an operational state of the air-conditioning related device, and information on a temperature of the area, or information on both a temperature and a humidity of the area, control information on an evaluated control to be executed for the air-conditioning related device, a set of building models representing thermal characteristics of the building or both thermal characteristics and humidity characteristics of the building, the set of building models including a thermal characteristic model that includes at least outside air temperature and indoor heat generation rate as factors influencing thermal characteristics, the thermal characteristic model including a thermal characteristic model that includes a parameter representing heat insulation performance of a frame of the building, and a thermal characteristic model that includes a parameter representing heat insulation performance and heat storage performance of the frame of the building, a candidate-model selection criterion representing a correspondence between a building model, and items included in each of the building information, the device information, and the observed data, determining an item available as input data for the building model from among the items included in each of the building information, the device information, and the observed data, and identifying a type of distribution of the observed data, selecting, based on the item available as the input data and the candidate-model selection criterion, a plurality of candidate building models from the set of building models, determining a parameter estimation method in correspondence with the type of distribution, and calculating, in accordance with the parameter estimation method, an estimated value for a parameter included in the plurality of selected candidate building models, calculating a predetermined statistic on the plurality of selected candidate building models, and determining, based on the statistic and a residual calculated for each of the plurality of selected candidate building models, one building model from the plurality of selected candidate building models, the residual being a residual between estimated and observed values of temperature or a residual between estimated and observed values of both temperature and humidity, and calculating, by using the determined building model, power consumption and a comfort evaluation value for the air-conditioning related device that result if each of the plurality of evaluated controls is executed.

Advantageous Effects of Invention

An embodiment of the present invention makes it possible to minimize the number of parameters necessary for estimating variation of the power consumption of an air-conditioning related device and changes in indoor comfort, and also evaluate, in correspondence with a building where the air-conditioning related device is disposed, energy saving and indoor comfort for an air-conditioning control to be evaluated.

BRIEF DESCRIPTION OF DRAWINGS

FIG. 7A is an illustration, as represented in the form of a network, of a humidity characteristic model included in the set of humidity characteristic models for the air-conditioning control evaluation apparatus according to Embodiment 1 of the present invention.

FIG. 7B is an illustration, as represented in the form of a network, of a humidity characteristic model included in the set of humidity characteristic models for the air-conditioning control evaluation apparatus according to Embodiment 1 of the present invention.

FIG. 8 is a table illustrating an example of statistical values on individual models used by a model evaluation unit illustrated in FIG. 3.

DESCRIPTION OF EMBODIMENTS

Embodiment 1

Figure 1A:
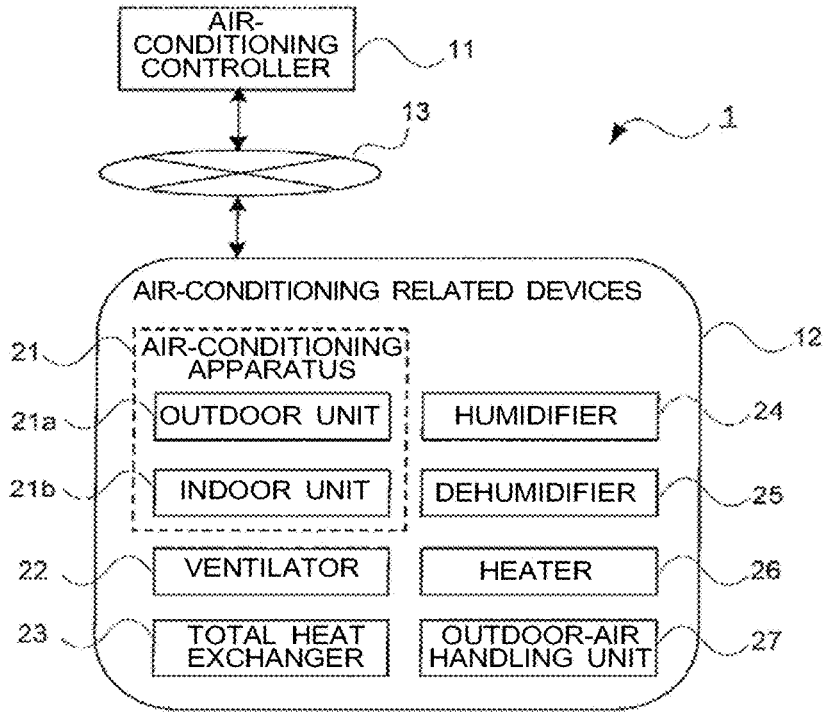
FIG. 1A is a block diagram illustrating one exemplary configuration of an air-conditioning system including an air-conditioning control evaluation apparatus according to Embodiment 1 of the present invention.

Configurations of an air-conditioning system including an air-conditioning control evaluation apparatus according to Embodiment 1 of the present invention will be described. FIG. 1A is a block diagram illustrating one exemplary configuration of an air-conditioning system including the air-conditioning control evaluation apparatus according to Embodiment 1 of the present invention.

As illustrated in FIG. 1A, an air-conditioning system 1 includes an air-conditioning controller 11, and an air-conditioning related device 12. The air-conditioning controller 11 is connected to the air-conditioning related device 12 via an air-conditioning network 13. The air-conditioning controller 11 includes the function of the air-conditioning control evaluation apparatus according to Embodiment 1. The configuration and operation of the air-conditioning control evaluation apparatus will be described later in detail with reference to FIGS. 3 to 11.

The air-conditioning controller 11 controls the air-conditioning related device 12 by transmitting, via the air-conditioning network 13, a control signal to the air-conditioning related device 12 in accordance with a preset control algorithm. The air-conditioning controller 11 also monitors the state of the air-conditioning related device 12 by receiving, via the air-conditioning network 13, information indicative of the state of the air-conditioning related device 12 from the air-conditioning related device 12.

Although FIG. 1A illustrates a configuration with one air-conditioning controller 11, the number of air-conditioning controllers 11 is not limited to one. For example, a plurality of air-conditioning controllers 11 may be connected to the air-conditioning network 13. The plurality of air-conditioning controllers 11 may be disposed at locations remote from each other. Although the air-conditioning controller 11 is typically disposed in a control room or other locations within a building, the air-conditioning controller 11 may not necessarily be disposed in a control room. If the air-conditioning system 1 includes a plurality of air-conditioning controllers 11, at least one of the air-conditioning controllers 11 may be provided with the function of the air-conditioning control evaluation apparatus described later.

The air-conditioning related device 12 includes the following components as illustrated in FIG. 1A: an outdoor unit 21*a*, an indoor unit 21*b*, a ventilator 22, a total heat exchanger 23, a humidifier 24, a dehumidifier 25, a heater 26, and an outdoor-air handling unit 27. The number of each of these components is often more than one. For example, in a multi-tenant building, the outdoor unit 21*a* and the indoor unit 21*b* are disposed for each tenant.

The above-mentioned components included in the air-conditioning related device 12 are merely exemplary, and not intended to be limiting. Not all of the above-mentioned components need to be included in the air-conditioning related device 12. Other than the above-mentioned components, the air-conditioning related device 12 may include other types of devices that control the condition of indoor air. A plurality of air-conditioning related devices 12 each including a plurality of components may be provided. The air-conditioning related device 12 may constitute a single component.

A component including the outdoor unit 21*a* and the indoor unit 21*b* will be referred to as air-conditioning unit 21. Although FIG. 1A illustrates a configuration with one air-conditioning unit 21, the number of air-conditioning units 21 is not limited to one. For example, the air-conditioning system 1 may be provided with two or more air-conditioning units 21. The number of outdoor units 21 and the number of indoor units 21*b* are not limited to one, either.

The air-conditioning unit 21 may be provided with a plurality of types of sensors including a temperature sensor and a humidity sensor. The air-conditioning unit 21 may have a communication function for communicating with the air-conditioning controller 11 via the air-conditioning network 13. Of the components included in the air-conditioning related device 12, some or all of the components excluding the air-conditioning unit 21 may have a sensor that measures temperature, humidity, or other physical quantities, and may have the function of communicating with the air-conditioning controller 11 via the air-conditioning network 13.

The air-conditioning network 13 may be, for example, implemented as a communication medium for performing communication in compliance with a communication protocol that is not open to the public, or implemented as a communication medium for performing communication in compliance with a communication protocol that is open to the public. The air-conditioning network 13 may be configured such that, for example, different types of networks coexist depending on the type of the cable used or on the communication protocol. In one conceivable example, such different types of networks include a dedicated network used for performing measurement/control on the air-conditioning related device 12, a local area network (LAN), and an individual dedicated line that differs for each different component of the air-conditioning related device 12.

Figure 1B:
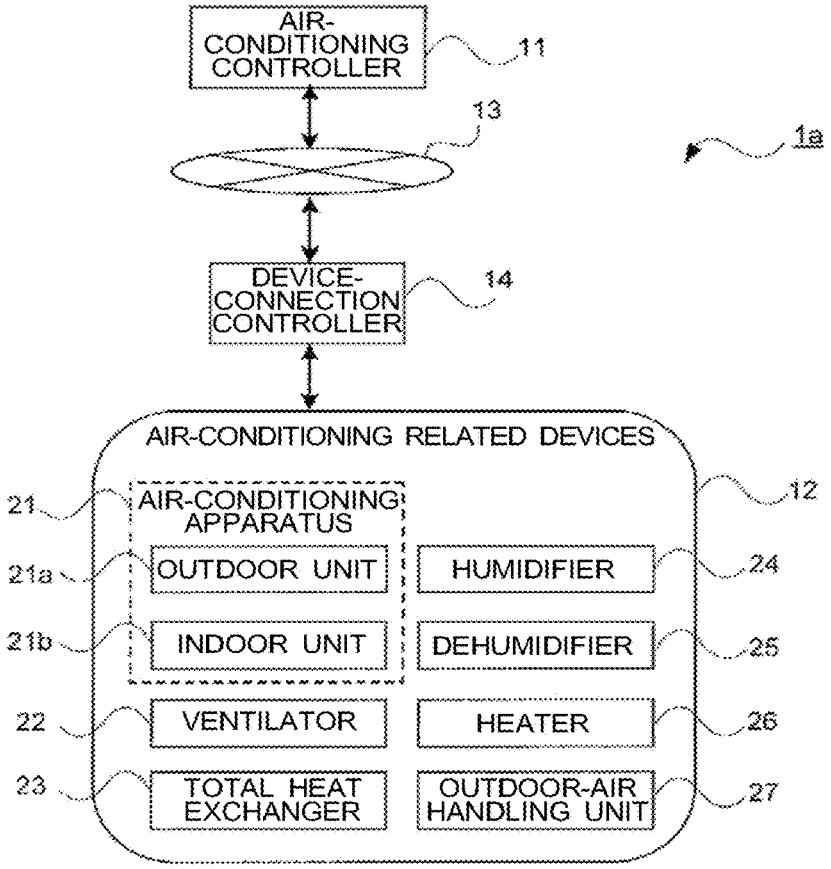
FIG. 1B is a block diagram illustrating another exemplary configuration of an air-conditioning system including the air-conditioning control evaluation apparatus according to Embodiment 1 of the present invention.

FIG. 1B is a block diagram illustrating another exemplary configuration of an air-conditioning system including the air-conditioning control evaluation apparatus according to Embodiment 1 of the present invention.

As illustrated in FIG. 1B, in comparison to the configuration illustrated in FIG. 1A, an air-conditioning system 1*a* is configured to further include a device-connection controller 14, which is connected to each of the air-conditioning network 13 and the air-conditioning related device 12 via a communication cable. The air-conditioning related device 12 is connected to the air-conditioning controller 11 via the device-connection controller 14 and the air-conditioning network 13.

The device-connection controller 14 is equipped with the function of relaying communication of data between the air-conditioning controller 11 and the air-conditioning related device 12.

If the communication protocol used between the air-conditioning related device 12 and the device-connection controller 14 differs from the communication protocol used in the air-conditioning network 13, the device-connection controller 14 may have the function of a gateway that relays communication between the air-conditioning related device 12 and the air-conditioning controller 11. In this case, the device-connection controller 14 allows the communication protocol used in the air-conditioning related device 12 to be hidden to the air-conditioning network 13. Further, the device-connection controller 14 may have the function of monitoring the contents of communication between the air-conditioning related device 12 and the air-conditioning controller 11.

As with the configuration illustrated in FIG. 1A, the configuration illustrated in FIG. 1B may include a communication cable for directly connecting the air-conditioning network 13 and the air-conditioning related device 12 to each other. The configuration in this case may be such that, for example, some of the components of the air-conditioning related device 12 are directly connected to the air-conditioning network 13, and other components are connected to the air-conditioning network 13 via the device-connection controller 14.

Figure 1C:
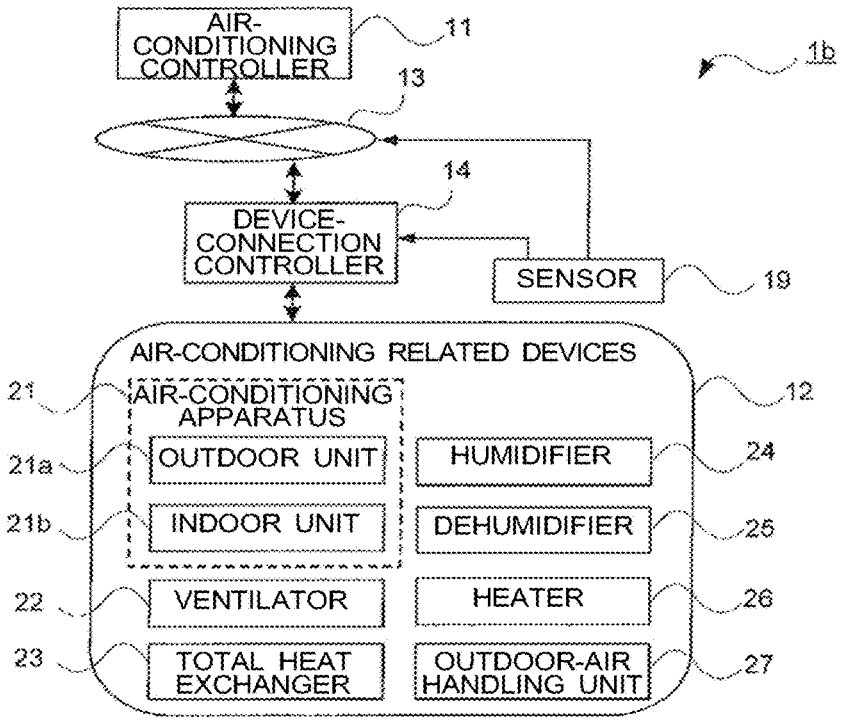
FIG. 1C is a block diagram illustrating another exemplary configuration of an air-conditioning system including the air-conditioning control evaluation apparatus according to Embodiment 1 of the present invention.

FIG. 1C is a block diagram illustrating another exemplary configuration of an air-conditioning system including the air-conditioning control evaluation apparatus according to Embodiment 1 of the present invention. As illustrated in FIG. 1C, in comparison to the configuration illustrated in FIG. 1B, an air-conditioning system 1*b* is configured to further include a sensor 19. The sensor 19 is a device that performs sensing, for example, a temperature sensor, a humidity sensor, or a $CO_2$ concentration sensor. The sensor 19 may be disposed, for example, in a location such as an indoor space, which is the air-conditioned space to be air-conditioned by the air-conditioning related device 12. The sensor 19 may be disposed outdoors if the sensor 19 is used to sense physical quantities such as outside air temperature and solar radiation rate.

In the exemplary configuration illustrated in FIG. 1C, the sensor 19 is connected to each of the air-conditioning network 13 and the device-connection controller 14 via a communication cable. The sensor 19 may transmit a detection value to the air-conditioning controller 11 via the air-conditioning network 13, or may transmit a detection value to the air-conditioning controller 11 via the device-connection controller 14 and the air-conditioning network 13.

Figure 10:
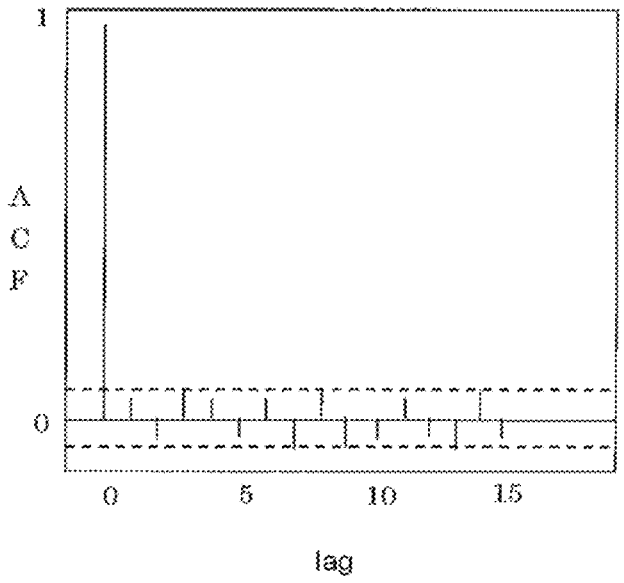
FIG. 10 is a graph illustrating an exemplary autocorrelation coefficient used by the model-residual evaluation unit illustrated in FIG. 3.

Although FIG. 10 depicts an exemplary configuration with only one sensor 19, the number of sensors 19 to be disposed is not limited to one but may be more than one. A plurality of devices for performing different types of sensing may be disposed as such sensors 19. The sensor 19 may be a single device capable of performing different types of sensing.

Although FIG. 1C illustrates a case in which the sensor 19 has two communication cables each connecting to either the air-conditioning network 13 or the device-connection controller 14, the sensor 19 may have only one of these two communication cables. With the configuration illustrated in FIG. 1C as well, a communication cable for directly connecting the air-conditioning network 13 and the air-conditioning related device 12 may be provided.

If the air-conditioning system 1 is provided with the air-conditioning controller 11 as illustrated in each of FIGS. 1A to 10, various functions included in the air-conditioning control evaluation apparatus described later are executed by the air-conditioning controller 11.

Although exemplary configurations of an air-conditioning system according to Embodiment 1 have been described above with reference to FIGS. 1A to 1C, the air-conditioning system may not necessarily be configured as described above. Another exemplary configuration of an air-conditioning system will be described below with reference to FIG. 2.

Figure 2:
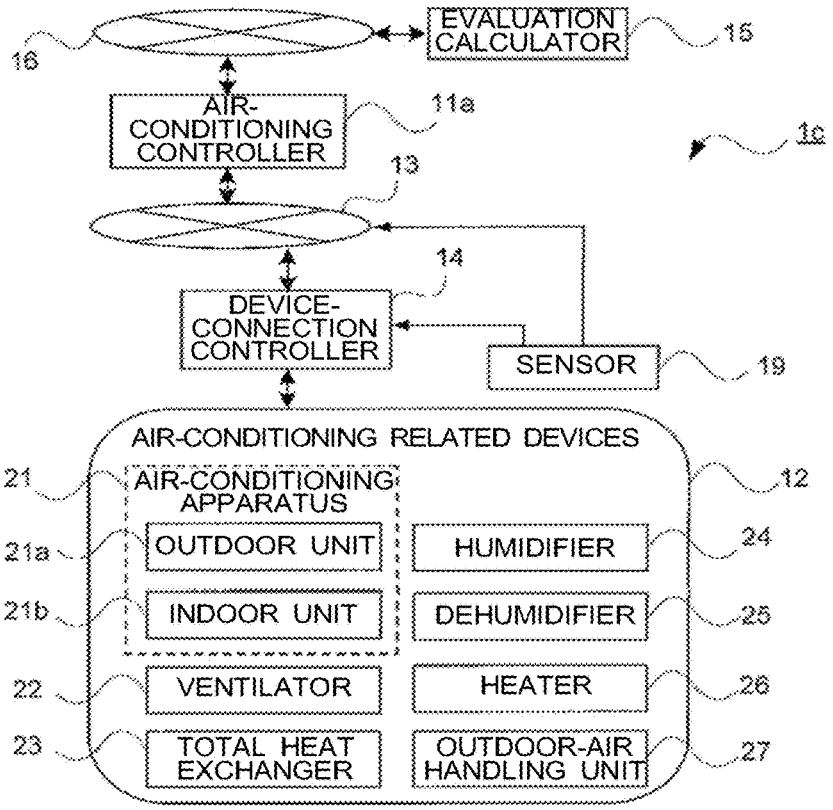
FIG. 2 is a block diagram illustrating another exemplary configuration of an air-conditioning system including the air-conditioning control evaluation apparatus according to Embodiment 1 of the present invention.

FIG. 2 is a block diagram illustrating another exemplary configuration of an air-conditioning system including the air-conditioning control evaluation apparatus according to Embodiment 1 of the present invention.

As illustrated in FIG. 2, the configuration of an air-conditioning system 1*c* is such that the configuration illustrated in FIG. 1C includes an evaluation calculator 15 having the function of the air-conditioning control evaluation apparatus described later. The evaluation calculator 15 is connected to an air-conditioning controller 11*a* via a general-purpose network 16. The air-conditioning controller 11*a* may not have the function of the air-conditioning control evaluation apparatus described later. The evaluation calculator 15 performs various kinds of communication with the air-conditioning controller 11*a* via the general-purpose network 16. The general-purpose network 16 is, for example, the Internet.

If the air-conditioning system 1*c* is provided with the air-conditioning controller 11*a* and the evaluation calculator 15 as illustrated in FIG. 2, the function of the air-conditioning control evaluation apparatus described later may be divided between the air-conditioning controller 11*a* and the evaluation calculator 15.

The location where the evaluation calculator 15 is disposed will be described below. The evaluation calculator 15 may be disposed together with the air-conditioning controller 11*a* in a location such as an indoor space, which is the air-conditioned space to be air-conditioned by the air-conditioning related device 12. The evaluation calculator 15 may not necessarily be disposed in the air-conditioned space but may be disposed on the same premises as the building where the air-conditioning related device 12 is disposed. The evaluation calculator 15 may be disposed in a location such as a central control center that is located remote from the building where the air-conditioning related device 12 is disposed and controls a plurality of buildings.

Although FIG. 2 illustrates a configuration in which the general-purpose network 16 and the evaluation calculator 15 are added to the air-conditioning system illustrated in FIG. 1C, these components may be added to, instead of the air-conditioning system illustrated in FIG. 1C, the air-conditioning system illustrated in FIG. 1A or 1B.

Although various implementations of the function of the air-conditioning control evaluation apparatus described later have been described above with reference to FIGS. 1A to 2, the illustrated configurations are not intended to be limiting. In one alternative example, the function of the air-conditioning controller 11, including the function of the air-conditioning control evaluation apparatus described later, may be distributed and implemented on a plurality of server devices (not illustrated). In another example, the function of the air-conditioning controller 11*a* and the function of the evaluation calculator 15 may be implemented on a single server device (not illustrated) in logically different forms. That is, as long as each individual function included in the air-conditioning controller 11 including the function of the air-conditioning control evaluation apparatus described later is executed, the physical location where each individual function is stored or executed is not limited.

(Configuration of Air-Conditioning Control Evaluation Apparatus)

A configuration of the air-conditioning control evaluation apparatus according to Embodiment 1 of the present invention will be described.

Figure 3:
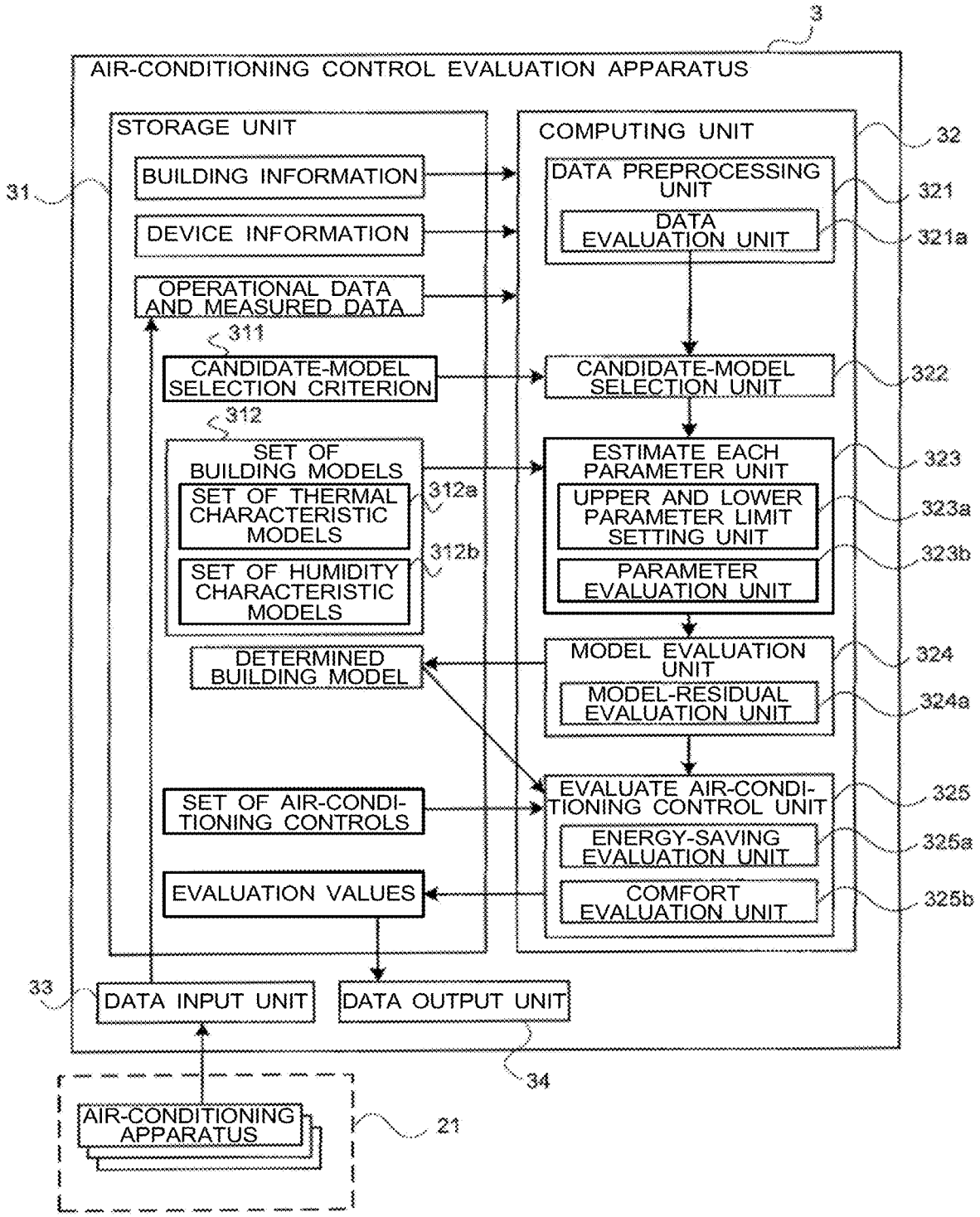
FIG. 3 is a block diagram illustrating one exemplary configuration of the air-conditioning control evaluation apparatus according to Embodiment 1 of the present invention.

FIG. 3 is a block diagram illustrating one exemplary configuration of the air-conditioning control evaluation apparatus according to Embodiment 1 of the present invention.

As illustrated in FIG. 3, the air-conditioning control evaluation apparatus 3 includes a storage unit 31, a computing unit 32, a data input unit 33, and a data output unit 34. The computing unit 32 includes a data preprocessing unit 321 including a data evaluation unit 321*a*, a candidate-model selection unit 322, a parameter estimation unit 323, a model evaluation unit 324, and an air-conditioning control evaluation unit 325.

Although it is assumed in this case that the air-conditioning system 1 described above with reference to FIG. 1A includes a plurality of air-conditioning units 21 serving as the air-conditioning related device 12 to be controlled, the following description will focus on only one air-conditioning unit 21 of interest. Although the following description of Embodiment 1 will be directed to a case where the air-conditioning system including the function of the air-conditioning control evaluation apparatus is the air-conditioning system 1 illustrated in FIG. 1A, the air-conditioning system is not limited to the air-conditioning system illustrated in FIG. 1A.

Hereinafter, the functions of various units of an air-conditioning control evaluation apparatus 3 illustrated in FIG. 3 will be described in detail.

(Storage Unit 31)

The storage unit 31 is, for example, a storage device including a hard disk device.

The storage unit 31 stores device information, operational data, and measured data, which are information related to the air-conditioning unit 21, and building information related to a building where the air-conditioning unit 21 is disposed. The storage unit 31 also stores a candidate-model selection criterion 311, a set of building models 312, which includes a set of thermal characteristic models 312*a* and a set of humidity characteristic models 312*b*, and a set of air-conditioning control information. Further, the storage unit 31 stores a determined building model determined by the computing unit 32, and evaluation values calculated by the computing unit 32.

Various information stored in the storage unit 31 will be described below.

Building information and device information stored in the storage unit 31 provide various conditions necessary for processes executed by various units included in the computing unit 32. Device information represents information including the characteristics of the air-conditioning unit 21. Examples of device information include the number of air-conditioning units 21, rated capacity, rated power consumption, a relational expression relating power consumption to rated capacity, and an algorithm for controlling various actuators of the air-conditioning unit 21 based on a value detected by a sensor disposed in the air-conditioning unit 21.

Device information also includes information on the configuration of an air-conditioning system, such as how the outdoor unit 21*a* and the indoor unit 21*b* are connected to each other and where the air-conditioning unit 21 is disposed. Device information may further include information such as the type of data transmitted and received between each of the data input unit 33 and the data output unit 34, and the air-conditioning unit 21, and the intervals of data transmission and reception. Although Embodiment 1 is directed to a case in which the air-conditioning related device 12 is the air-conditioning unit 21, the storage unit 31 may store device information on individual components of the air-conditioning related device 12.

Building information includes information on the area where the air-conditioning unit 21 is disposed. Examples of building information include the floor on which the air-conditioning unit 21 is disposed in a building, the surface area of the floor, the volume of a room, and the expected maximum number of persons in the room. In the following description, the floor on which the air-conditioning unit 21 subjected to an evaluated air-conditioning control, which is an air-conditioning control to be evaluated, is disposed will be referred to as "evaluated floor". Building information may include information on each individual component of the air-conditioning related device 12 disposed on the evaluated floor. An example of information on each individual component is information indicating whether the humidifier 24 is disposed. If the air-conditioning system is the system illustrated in FIG. 1C, building information may include information on the location where the sensor 19 is disposed.

Operational data and measured data that are stored in the storage unit 31 represent data indicating the operational state of the air-conditioning unit 21. Operational data represents data indicating, for example, whether the thermo is in on-state or off-state, and the operational state of a return air fan. Measured data represents data measured by various units of the air-conditioning unit 21. Examples of measured data include temperature, airflow rate, humidity, and electric power measured by various units. Each such measured data may include not only current data but also past data.

The data items listed above are merely illustrative of representative examples of each of operational data and measured data, and not intended to be limiting. Each of operational data and measured data may not include all of the above-mentioned items. In the following description, operational data and measured data will be referred to as observed data, and information including device information and observed data will be referred to as device-related information.

The candidate-model selection criterion 311 stored in the storage unit 31 defines the correspondence between the presence/absence of each input data item evaluated by the data evaluation unit 321*a* as well as each set value included in building information and device information, and each candidate building model to be selected. Based on the candidate-model selection criterion 311 and the results of determination made by the data evaluation unit 321*a*, a plurality of candidate models to be considered by the parameter estimation unit 323 are selected from the set of building models 312. The candidate-model selection criterion 311 will be described later in detail. Examples of set values included in building information and device information include the rated capacity of the air-conditioning unit 21, and the floor area of the evaluated floor.

The set of building models 312 stored in the storage unit 31 includes the set of thermal characteristic models 312*a* including a plurality of thermal characteristic models, and the set of humidity characteristic models 312*b* including a plurality of humidity characteristic models. The thermal characteristic models and the humidity characteristic models will be described later in detail.

A determined building model stored in the storage unit 31 is a building model selected by the model evaluation unit 324 of the computing unit 32 from among a plurality of building models as a building model to be used in evaluating energy saving and comfort. A determined building model may include one or both of a thermal characteristic model and a humidity characteristic model.

A set of air-conditioning control information stored in the storage unit 31 represents algorithms relating to a plurality of evaluated controls and executed by the air-conditioning unit 21. Examples of an algorithm related to a control include a control algorithm for achieving energy saving through cooperation of the air-conditioning unit 21 and the ventilator 22, and a control algorithm for achieving energy saving through optimal combination of activation and deactivation of the air-conditioning unit 21. In the following description, a control executed by the air-conditioning related device 12 including the air-conditioning unit 21 will be referred to as "air-conditioning control".

Evaluation values stored in the storage unit 31 include an energy-saving evaluation value and a comfort evaluation value, which are calculated by the air-conditioning control evaluation unit 325 of the computing unit 32. An energy-saving evaluation value corresponds to a value serving as an indicator of energy saving, and a comfort evaluation value corresponds to a value serving as an indicator of comfort.

Examples of energy-saving evaluation values include the difference in the power consumption of the air-conditioning unit 21 between when a given evaluated air-conditioning control is executed and when another air-conditioning control is executed, the ratio of the difference to the power consumption corresponding to a reference control, and time-series data on power consumption. Examples of comfort evaluation values include a predicted mean vote (PMVs) as an indicator of comfort for each of a case where a given evaluated air-conditioning control is executed and a case where another air-conditioning control is executed, the variations of indoor temperature and indoor humidity between before and after the execution of the control, and time-series data on indoor temperature and indoor humidity.

Thermal characteristic models and humidity characteristic models will be described below.

(Thermal Characteristic Models)

Figure 4:
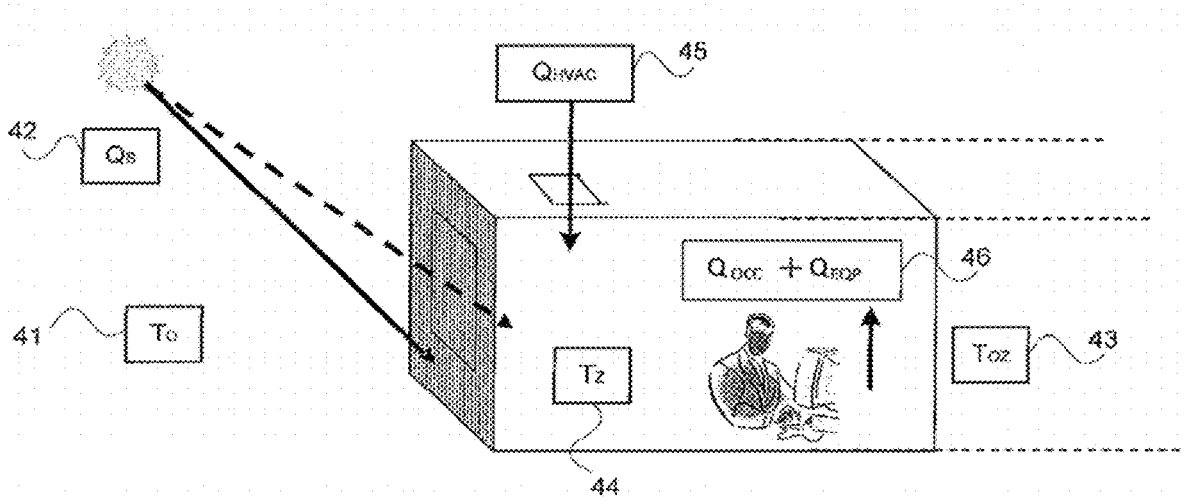
FIG. 4 is a schematic illustration of a thermal characteristic model included in a set of thermal characteristic models for the air-conditioning control evaluation apparatus according to Embodiment 1 of the present invention.

FIG. 4 is a schematic illustration of a thermal characteristic model included in a set of thermal characteristic models for the air-conditioning control evaluation apparatus according to Embodiment 1 of the present invention. FIG. 4 illustrates an example of various factors to be considered in the thermal characteristic model. The thermal characteristic model illustrated in FIG. 4 considers the following factors as factors influencing thermal load: outside air temperature ($T_O$) 41, solar radiation rate ($Q_S$) 42, adjacent-room temperature ($T_{OZ}$) 43, indoor temperature ($T_Z$) 44, rate of heat removal by air-conditioning ($Q_{HVAC}$) 45, and indoor heat generation rate ($Q_{OCC}$+$Q_{EQP}$) (human body+OA equipment+lighting) 46.

Figure 5A:
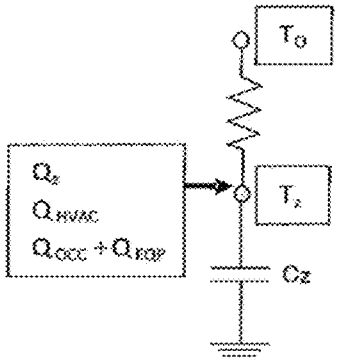
FIG. 5A is an illustration, as represented in the form of a thermal network, of a thermal characteristic model included in the set of thermal characteristic models for the air-conditioning control evaluation apparatus according to Embodiment 1 of the present invention.

FIGS. 5A to 5G are each an illustration, as represented in the form of a thermal network, of a thermal characteristic model included in the set of thermal characteristic models for the air-conditioning control evaluation apparatus according to Embodiment 1 of the present invention. FIGS. 5A to 5G each illustrate an exemplary thermal network model used to express the relationship between the above-mentioned factors influencing thermal load. In this case, FIGS. 5A to 5G are used to represent a plurality of exemplary models that vary with the number of dimensions in which the heat quantity balance is to be considered. FIG. 5A represents a one-dimensional model that serves as the basis for the models of FIGS. 5B to 5G. FIG. 5A represents a thermal characteristic model in which indoor temperature and outside air temperature are connected by a single thermal resistance, and the thermal capacity of a room is considered. This thermal characteristic model represents the simplest thermal characteristic model indicating that variation of outside air temperature contributes to variation of indoor temperature with no time delay with a certain degree of influence. For buildings with low heat storage performance, it is sometimes possible to represent the thermal characteristics of such a building by the thermal characteristic model of FIG. 5A.

Figure 5B:
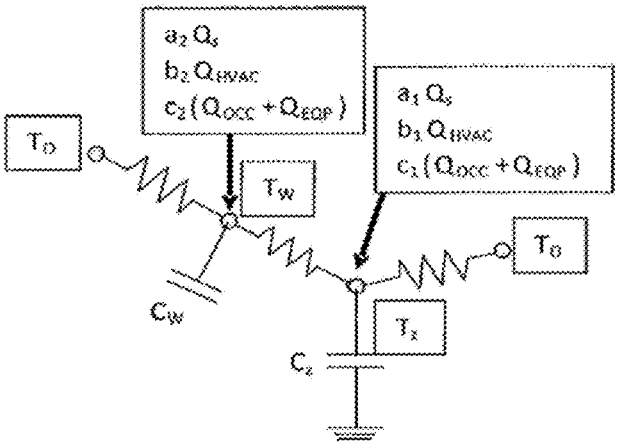
FIG. 5B is an illustration, as represented in the form of a thermal network, of a thermal characteristic model included in the set of thermal characteristic models for the air-conditioning control evaluation apparatus according to Embodiment 1 of the present invention.

An example of a model equation for a thermal network model illustrated in FIG. 5B is expressed by each of Eq. (1) and Eq. (2). It may be appreciated that the thermal network model illustrated in FIG. 5B considers the following factors as factors influencing thermal load: the outside air temperature ($T_O$) 41, the solar radiation rate ($Q_S$) 42, the adjacent-room temperature ($T_{OZ}$) 43, the indoor temperature ($T_Z$) 44, the rate of heat removal by air-conditioning ($Q_{HVAC}$) 45, and the indoor heat generation rate ($Q_{OCC}$+$Q_{EQP}$) (human body+OA equipment+lighting) 46. The model of FIG. 5B, which takes the building frame and the thermal capacity of a room into consideration, is a model in which there are divided two components: a component due to variation of outside air temperature that contributes to variation of indoor temperature with no time delay with a certain degree of influence, for example, heat transfer due to ventilation; and a component that contributes to variation of indoor temperature with a time delay occurring when heat passes through the building frame. This model makes it possible to consider, for a building with high heat insulation performance and heat storage performance, a thermal load with a time delay due to the heat of transmission and a thermal load with no time delay due to, for example, ventilation.

[Eq. 1]

$$C_w\frac{dT_W}{dt} = a_2Q_s + b_2Q_{HVAC} + c_2Q_{OCC} + c_2Q_{EQP} + \frac{(T_O - T_w)}{R_W} - \frac{(T_Z - T_w)}{R_Z} \quad (1)$$

[Eq. 2]

$$C_z\frac{dT_Z}{dt} = a_1Q_s + b_1Q_{HVAC} + c_1Q_{OCC} + c_1Q_{EQP} + \frac{(T_O - T_Z)}{R_{WN}} - \frac{(T_W - T_Z)}{R_Z} - \frac{(T_Z - T_{OZ})}{R_{OZ}} \quad (2)$$

In Eqs. (1) and (2), $Q_S$ denotes solar radiation rate [kW/m$^2$], $Q_{OCC}$ denotes rate of heat generation by human body [kW], $Q_{EQP}$ denotes rate of heat generation by OA equipment and lighting equipment [kW], and $Q_{HVAC}$ denotes rate of heat removal (supply) by the air-conditioning unit 21 [kW]. Further, $T_O$ denotes outside air temperature [K], $T_W$ denotes exterior wall temperature [K], $T_Z$ denotes indoor temperature [K], and $T_{OZ}$ denotes adjacent-room temperature [K]. $R_W$ denotes outdoor-side heat transfer coefficient [kW/K], $R_Z$ denotes indoor-side heat transfer coefficient [kW/K], $R_{OZ}$ denotes interior-wall thermal conductivity [kW/K], and $R_{WIN}$ denotes window heat transfer coefficient [kW/K].

$C_W$ denotes exterior-wall thermal capacity [kJ/K], and $C_Z$ denotes indoor thermal capacity [kJ/K]. "a1" denotes a coefficient [−] of the rate of solar radiation entering indoors, and "a2" denotes a coefficient [−] of the rate of solar radiation impinging on the exterior wall. "b1" and "b2" each denote a coefficient [−] of the rate of heat removal (supply) by air conditioning. "c1" and "c2" each denote a coefficient [−] of the rate of heat generation by OA equipment, lighting equipment, and human body.

If an evaluated floor is not divided into a plurality of areas by a wall, that is, if the evaluated floor is regarded as a single area, there is no need to consider the adjacent-room temperature ($T_{OZ}$) 43. Accordingly, the adjacent-room temperature ($T_{OZ}$) 43 and the interior-wall thermal conductivity $R_{OZ}$ are ignored.

Figure 5C:
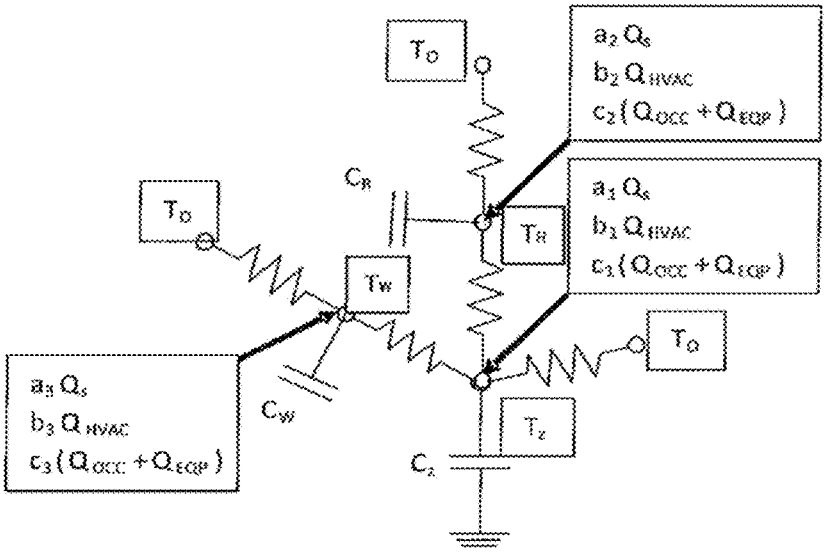
FIG. 5C is an illustration, as represented in the form of a thermal network, of a thermal characteristic model included in the set of thermal characteristic models for the air-conditioning control evaluation apparatus according to Embodiment 1 of the present invention.

Next, a thermal network model illustrated in FIG. 5C will be described. FIG. 5C represents a thermal characteristic model corresponding to FIG. 5B that additionally takes the temperature and thermal capacity of the roof into account. Adding the temperature of the roof ($T_R$) and the thermal capacity of the roof ($C_R$) into the model has the following effect. That is, the roof and the exterior wall generally differ in material. Accordingly, as for the rate of solar radiation incident on the roof surface, the influence of the quantity of heat entering and leaving via the roof and the building frame other than the roof can be considered separately for each of the roof and the building frame other than the roof.

Figure 5D:
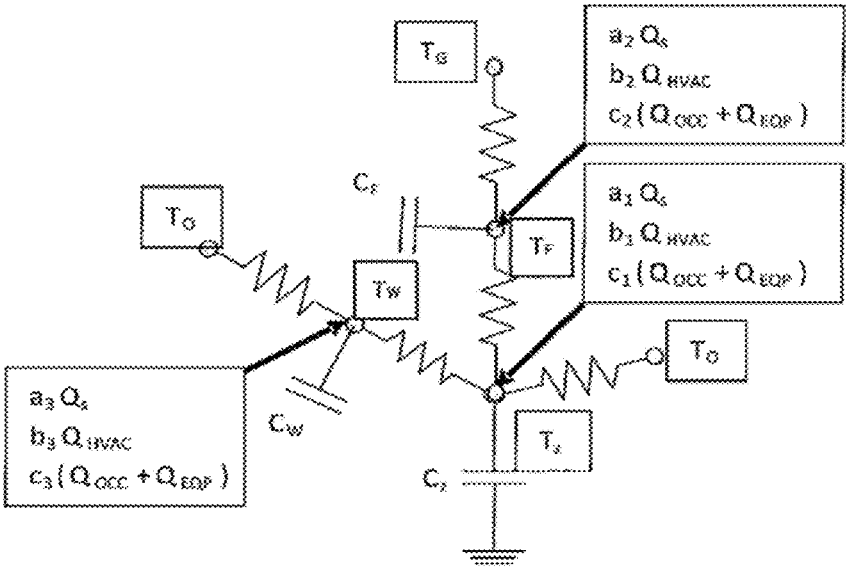
FIG. 5D is an illustration, as represented in the form of a thermal network, of a thermal characteristic model included in the set of thermal characteristic models for the air-conditioning control evaluation apparatus according to Embodiment 1 of the present invention.

Next, a thermal network model illustrated in FIG. 5D will be described. FIG. 5D represents a thermal characteristic model corresponding to FIG. 5B that additionally takes the temperature and thermal capacity of the floor into account. With the temperature of the floor surface ($T_F$), the thermal capacity of the floor surface ($C_F$), and further, ground surface temperature ($T_G$) added to the model, components contributing to variation of indoor temperature via the floor, which generally differs in material from the exterior wall, can be considered separately from the exterior wall.

Figure 5E:
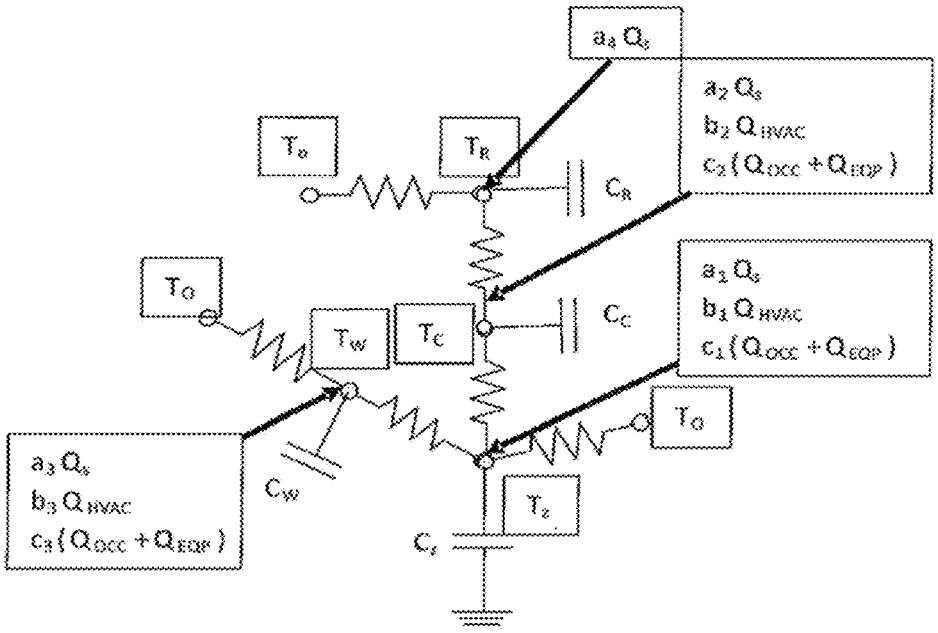
FIG. 5E is an illustration, as represented in the form of a thermal network, of a thermal characteristic model included in the set of thermal characteristic models for the air-conditioning control evaluation apparatus according to Embodiment 1 of the present invention.

Next, a thermal network model illustrated in FIG. 5E will be described. FIG. 5E represents a thermal characteristic model corresponding to FIG. 5D that additionally takes the temperature and thermal capacity of the space above a ceiling into account. With the temperature of the space above a ceiling ($T_C$) and the thermal capacity of the space above a ceiling ($C_C$) added into the model, components contributing to variation of indoor temperature with a time delay from the space above a ceiling can be considered separately from the exterior wall.

Figure 5F:
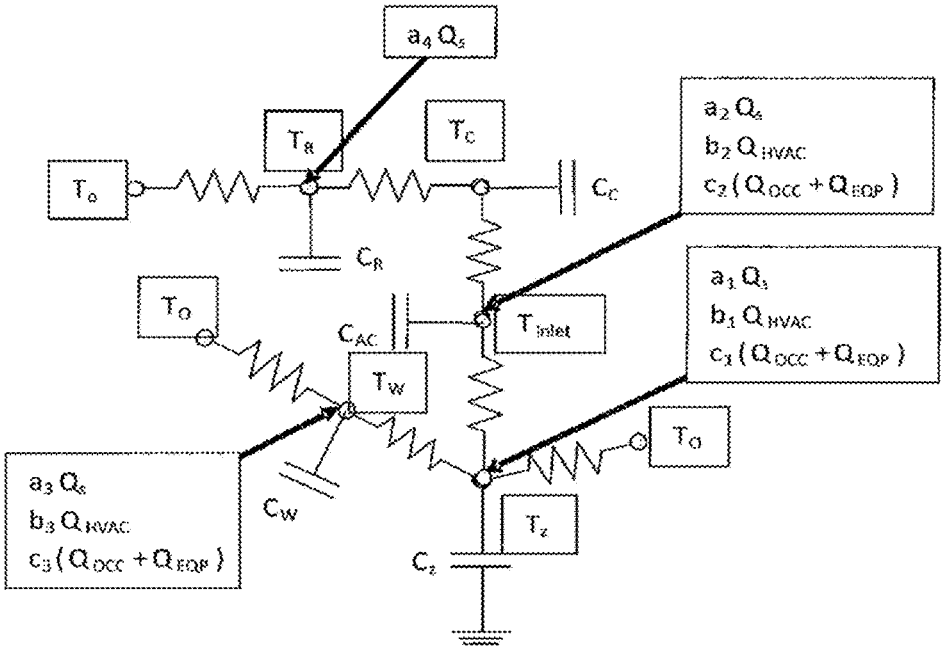
FIG. 5F is an illustration, as represented in the form of a thermal network, of a thermal characteristic model included in the set of thermal characteristic models for the air-conditioning control evaluation apparatus according to Embodiment 1 of the present invention.

Next, a thermal network model illustrated in FIG. 5F will be described. FIG. 5F represents a thermal characteristic model corresponding to FIG. 5E that additionally includes the thermal capacity of an air-conditioning unit disposed near the ceiling ($C_{AC}$), and suction temperature measured by a sensor disposed in the air-conditioning unit ($T_{inlet}$). When the air-conditioning unit is running, that is, when the fan for sucking indoor air is running, the indoor temperature and the suction temperature measured by the air-conditioning unit may be considered equal. When the air-conditioning unit is at rest, however, the suction temperature measured by the air-conditioning unit is considered to represent not the indoor temperature but the temperature near the ceiling. Accordingly, by adding the thermal capacity and suction temperature of the air-conditioning unit to the model, the temperature to be regarded as indoor temperature can be changed between when the air-conditioning unit is running and when the air-conditioning unit is at rest.

Figure 5G:
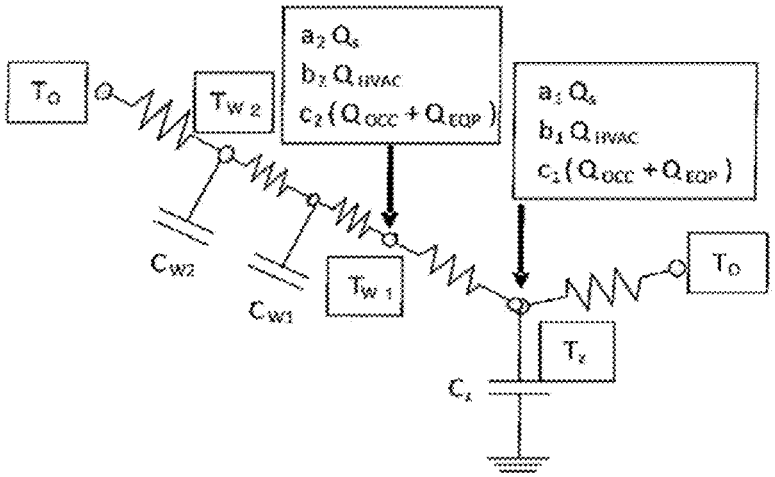
FIG. 5G is an illustration, as represented in the form of a thermal network, of a thermal characteristic model included in the set of thermal characteristic models for the air-conditioning control evaluation apparatus according to Embodiment 1 of the present invention.

Next, a thermal network model illustrated in FIG. 5G will be described. FIG. 5G represents a thermal characteristic model that separates the temperature of the frame portion illustrated in FIG. 5B into the indoor-side surface temperature ($T_{W1}$) and outdoor-side surface temperature ($T_{W2}$) of the frame, and further separates the thermal capacity of the frame into indoor-side thermal capacity ($C_{W1}$) and outdoor-side thermal capacity ($C_{W2}$). Adding the frame's indoor-side and outdoor-side surface temperatures to the model makes it possible to estimate the surface temperature of the frame. The surface temperature of the frame contributes to variation of indoor temperature, and also can be used for comfort evaluation as a value representing the temperature of heat radiated to the human body.

The above-mentioned thermal network models are merely illustrative of exemplary thermal characteristic models, and not intended to limit the thermal characteristic model to those mentioned above. For instance, if it is desired to take radiation from a wall into account, a thermal network model may be constructed in such a way that enables calculation of the surface temperature of the wall.

(Humidity Characteristic Models)

Figure 6:
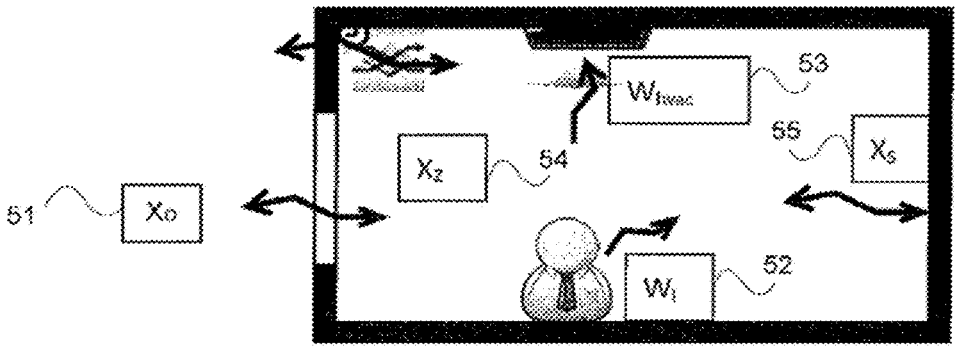
FIG. 6 is a schematic illustration of a humidity characteristic model included in a set of humidity characteristic models for the air-conditioning control evaluation apparatus according to Embodiment 1 of the present invention.

FIG. 6 is a schematic illustration of a humidity characteristic model included in the set of humidity characteristic models illustrated in FIG. 3.

FIG. 6 schematically illustrates an example of various factors to be considered in the humidity characteristic model. For example, the humidity characteristic model considers the following factors as factors influencing humidity: outside-air absolute humidity ($X_O$) 51, indoor moisture generation rate ($W_i$) 52, dehumidification rate during cooling of the air-conditioning unit ($W_{HVAC}$) 53, indoor absolute humidity ($X_Z$) 54, and surface absolute humidity ($X_S$) 55, which represents absorption and desorption of moisture by walls or other structural elements. The meaning of the expression "walls or other structural elements" as used herein includes structural objects defining the air-conditioned space, including the walls, the floor, and the ceiling, as well as objects (such as furniture) disposed in the air-conditioned space.

FIGS. 7A and 7B each schematically illustrate a humidity characteristic model included in the set of humidity characteristic models for the air-conditioning control evaluation apparatus according to Embodiment 1 of the present invention.

The humidity characteristic model of FIG. 7A will be described below as an example.

The humidity characteristic model of FIG. 7A considers the following factors as factors influencing humidity: outside-air humidity, indoor moisture generation rate, dehumidification by the air-conditioning unit (during cooling), and absorption and desorption of moisture by walls or other structural elements.

Eq. (3) below is derived by representing, by a theoretical equation (moisture balance equation), the relational expression expressing the relationship between the above-mentioned factors influencing humidity.

[Eq. 3]

$$\rho V\frac{dX_Z}{dt} = \rho G_v(X_o - X_Z) + \sigma W_i + \omega W_{HVAC} + \sum a_j A_j (X_{s,j} - X_Z) + \rho G_d (X_o - X_Z) \quad (3)$$

In Eq. (3), $X_Z$ denotes indoor absolute humidity [kg/kg'], V denotes indoor volume [$m^3$], $X_O$ denotes outside-air absolute humidity [kg/kg'], $G_V$ denotes ventilation rate [$m^3$/sec], and $W_i$ denotes indoor moisture generation rate [kg/sec]. $W_{HVAC}$ denotes dehumidification rate during cooling of the air-conditioning unit [kg/sec], "a" denotes surface moisture transfer coefficient [kg/$m^2$/h/(kg/kg')], "A" denotes surface area [$m^2$], and $X_S$ denotes surface absolute humidity [kg/kg']. $G_d$ denotes draft flow rate [$m^3$/sec], ρ denotes air density [kg/$m^3$], σ denotes correction coefficient [–] of indoor moisture generation rate, ω denotes correction coefficient [–] of the dehumidification rate during cooling of the air-conditioning unit, and j denotes the number of surfaces for which absorption and desorption of moisture is to be considered.

Next, a humidity characteristic model illustrated in FIG. 7B will be described. FIG. 7B represents a model corresponding to FIG. 7A that additionally takes the rate of humidification by the humidifier 24 ($W_{HUMI}$) into account. Adding the rate of humidification by the humidifier into the humidity characteristic model makes it possible to separate factors affecting a rise in indoor humidity into human-derived factors and humidifier-derived factors.

The above-mentioned models are merely illustrative of exemplary humidity characteristic models, and not intended to limit the humidity characteristic model to those mentioned above. For instance, if it is desired to take the rate of dehumidification by the dehumidifier 25 into account, a humidity characteristic model may be constructed in such a way that allows the dehumidification rate to be taken into account.

(Candidate-Model Selection Criterion 311)

The candidate-model selection criterion 311 represents the correspondence between each input data item available for a building model, and an associated building model to be selected. The candidate-model selection criterion 311 will be described below with reference to FIGS. 5A to 5G and FIGS. 7A and 7B.

An example of an item to be considered in selecting a thermal characteristic model is information indicating which floor an evaluated floor corresponds to among all the floors in a building. Which thermal characteristic model is to be selected as a candidate building model varies depending on whether the evaluated floor included in the building information set by the user is the top floor, the first floor, or some intermediate floor between the top floor and the first floor. The two following thermal characteristic models serve as standard building models in this case: a thermal characteristic model that does not take the thermal capacity of the frame of the building into account (FIG. 5A); and a thermal characteristic model that does not separate the roof, the floor, and the exterior wall from each other but regards these structural components as a single frame, and takes thermal capacity of this frame into account (FIG. 5B). Either one of the following models serves as a comparative model: if the evaluated floor is the top floor, a thermal characteristic model that separates the roof (FIG. 5C); and if the evaluated floor is the first floor, a thermal characteristic model that separates the floor and additionally takes the influence of the ground surface temperature into account (FIG. 5D).

If indoor unit suction temperature is available from operational data and measured data as an input data item for a building model, it is regarded that when air conditioning is off, the indoor unit suction temperature represents a measurement of the temperature at the location where the indoor unit is disposed (near a ceiling or above a ceiling). In this case, in addition to the standard model illustrated in FIG. 5B, the thermal characteristic model illustrated in FIG. 5E is selected as a candidate thermal characteristic model.

If, in addition to the indoor unit suction temperature, the temperature detected by a sensor disposed near the top of a desk on the evaluated floor is available from operational data and measured data as an input data item for a building model, a thermal characteristic model that separates the temperature near the location of the indoor unit and the temperature of the living quarters from each other (FIG. 5F)

is selected as a candidate thermal characteristic model in addition to the standard model illustrated in FIG. 5B.

If wall surface temperature is available from operational data and measured data as an input data item for a building model, a thermal characteristic model that additionally takes wall surface temperature into account (FIG. 5G) is selected in addition to the standard model illustrated in FIG. 5B. For cases where wall surface temperature is not included but indoor temperature is included as an input data item, if it is desired to use wall surface temperature as the temperature of heat radiated to the human body in calculating a comfort evaluation value, then the model of FIG. 5G is selected in such cases as well.

An example of an item to be considered in selecting a humidity characteristic model is information indicating whether the humidifier 24 and the dehumidifier 25 are disposed on the evaluated floor, that is, the presence/absence of the humidifier 24 and the dehumidifier 25 on the evaluated floor. If the humidifier is disposed on the evaluated floor, a humidity characteristic model that takes humidification rate into account (FIG. 7B) is selected as a humidity characteristic model in addition to the standard model illustrated in FIG. 7A.

Each of the above-mentioned combinations of an item and an associated model is merely representative of an exemplary correspondence between an available input data item and an associated building model, and possible combinations are not limited to those mentioned above. Further, the candidate-model selection criterion 311 may define the correspondence between a plurality of combinations of input data and associated building models.

(Computing Unit 32)

As illustrated in FIG. 3, the computing unit 32 includes the data preprocessing unit 321, the candidate-model selection unit 322, the parameter estimation unit 323, the model evaluation unit 324, and the air-conditioning control evaluation unit 325. The parameter estimation unit 323 includes an upper and lower parameter limit setting unit 323*a* and a parameter evaluation unit 323*b*. The model evaluation unit 324 includes a model-residual evaluation unit 324*a*. The air-conditioning control evaluation unit 325 includes an energy-saving evaluation unit 325*a* and a comfort evaluation unit 325*b*.

The computing unit 32 includes a memory (not illustrated) that stores a program, and a central processing unit (CPU) (not illustrated) that executes processing in accordance with the program. The memory (not illustrated) provided in the computing unit 32 is, for example, a non-volatile memory including an electrically erasable and programmable read only memory (EEPROM) and a flash memory. As the CPU executes the program, the data preprocessing unit 321, the candidate-model selection unit 322, the parameter estimation unit 323, the model evaluation unit 324, and the air-conditioning control evaluation unit 325 are implemented in the air-conditioning control evaluation apparatus 3. The program describes a procedure for calculating values representing statistical properties such as mean, standard deviation, and autocorrelation coefficient, and a procedure related to statistical processing including model selection based on an information criterion or a test.

(Data Preprocessing Unit 321)

The data preprocessing unit 321 executes preprocessing of various data used by the computing unit 32, and analysis of various data. For example, the data preprocessing unit 321 executes processes such as removal of outliers due to sensor abnormality, time step unification, and interpolation of missing values, as processes other than processes executed by the data evaluation unit 321*a* described below.

(Data Evaluation Unit 321*a*)

The data evaluation unit 321*a* checks input data including building information, device information, operational data, and measured data, and calculates the statistical properties of the operational data and measured data. Checking input data means determining whether all data types used by the computing unit 32 are present. If the data evaluation unit 321*a* determines that some of input data are missing, then the data evaluation unit 321*a* determines whether to use a default value previously stored in the storage unit 31, select a model that does not use the missing data, or notify the user that some of necessary input data are missing.

An example of an input data item for which it is possible to use a default value is room volume. Even if a room volume is not registered in the storage unit 31, if the floor size has been registered in the storage unit 31 in advance by user's setting, then, as data preprocessing, the data evaluation unit 321*a* is able to calculate the room volume by multiplying the surface area by a default ceiling height.

An example of a data item for which it is not possible to use a default value is measured data of indoor humidity. If measured data of indoor humidity is not registered in the storage unit 31, the data evaluation unit 321*a* determines not to use the set of humidity characteristic models 312*b* among the set of building models 312.

As a result, the candidate-model selection unit 322 described later is able to determine which candidate building model is to be selected, by comparing information on the presence/absence of input data checked by the data evaluation unit 321*a* and the numerical value of input data, against the candidate-model selection criterion 311.

The data evaluation unit 321*a* checks, for operational data and measured data, indices representative of statistical properties, such as mean, standard deviation, and variance, and identifies the type of the distribution of these observed data. In the following description, information including the type of distribution will be referred to as "distribution information". Checking whether the output data to be estimated by a model follows a normal distribution is particularly important as this affects selection of a technique used by the parameter estimation unit 323. For this reason, the data evaluation unit 321*a* always checks whether observed data follows a normal distribution. Examples of normality testing methods include the Shapiro-Wilk normality test, and the Kolmogorov-Smirnov test.

If the hypothesis of normality of the observed data is not rejected, the least-squares method is employed as a parameter estimation method used by the parameter estimation unit 323. If the hypothesis of normality of the observed data is rejected, the maximum likelihood method is employed as a parameter estimation method. If the hypothesis of normality of the observed data is rejected, and multimodality is observed in the observed data, then sampling techniques that are also applicable to multimodal data (for example, the Markov Chain Monte Carlo (MCMC) method) or other techniques are used as parameter estimation methods.

(Candidate-Model Selection Unit 322)

The candidate-model selection unit 322 selects a plurality of candidate building models from the set of building models 312, based on each available input data item checked by the data preprocessing unit 321 and the candidate-model selection criterion 311. In selecting each candidate building model, the candidate-model selection unit 322 may reference not only an input data item but also the numerical value of the input data item.

(Parameter Estimation Unit 323)

The parameter estimation unit 323 calculates, for each parameter in a plurality of candidate building models selected by the candidate-model selection unit 322, the value of the parameter in accordance with a parameter estimation method corresponding to information on the distribution of operational data and measured data. For example, if the type of the distribution of operational data and measured data is normal distribution, the parameter estimation unit 323 employs the least-squares method as a parameter estimation method, and determines the value of each parameter in a building model in such a way that minimizes the sum of squared residuals between the observed and estimated values of the output data of the building model. If the type of the distribution of operational data and measured data is not normal distribution, the parameter estimation unit 323 employs the maximum likelihood method as a parameter estimation method, and determines the value of each parameter in a building model in such a way that maximizes the likelihood of the building model. It is to be noted, however, that if multimodality is observed in the distribution of operational data and measured data, the parameter estimation unit 323 employs a sampling technique as a parameter estimation method.

As described above, the parameter estimation unit 323 varies the parameter estimation method in accordance with the information on the distribution of operational data and measured data checked by the data evaluation unit 321*a*.

An example of observed and estimated values of the output data of a building model will be described below. Now, attention is given to, for example, Eqs. (1) and (2) for a case where a building model of interest is the thermal characteristic model illustrated in FIG. 5B. Assuming that output data obtained by inputting, as input data, the values of items included in device-related information and building information into the right-hand side of each of Eqs. (1) and (2) represents an observed value, the output data on the right-hand side of each of Eqs. (1) and (2) is an estimated value. If the data on the right-hand side of Eq. (1) is available as an observed value, then |"right-hand side of Eq. (1)"−"left-hand side of Eq. (1)"|=|observed value−estimated value|=residual e. If the data on the right-hand side of Eq. (2) is available as an observed value, then |"right-hand side of Eq. (2)"−"left-hand side of Eq. (2)"|=|observed value−estimated value|=residual e. If both the data on the right-hand side of Eq. (1) and the data on the right-hand side of Eq. (2) are available as observed values, the sum of the residual of Eq. (1) and the residual of Eq. (2) may be defined as the residual e. The closer to zero the residual e is, the more accurately the input data and each parameter of the building model are regarded as representing the output data.

(Upper and Lower Parameter Limit Setting Unit 323*a*)

The upper and lower parameter limit setting unit 323*a* sets the initial value for each parameter, and the upper limit and lower limit for the parameter. These values are used in calculating an estimate for each parameter by using the least-squares method or other techniques (such as the maximum likelihood method and sampling). In the following description, the upper limit and the lower limit will be referred to as "upper and lower limits". The rate of convergence and evaluation value of a solution vary with the initial value and upper and lower limits of each parameter. This makes it necessary to set the initial value and the upper and lower limits to appropriate values.

The upper and lower parameter limit setting unit 323*a* varies the initial value and upper and lower limits of each parameter in accordance with a building model of interest and associated building information and device information. For instance, the exterior-wall thermal capacity $C_W$ for a thermal characteristic model that does not separate the roof, the floor, and the exterior wall from each other but regards these structural components as a single frame (FIG. 5B), differs from the exterior-wall thermal capacity $C_W$ for a thermal characteristic model that separates the roof (ceiling) from other structural components (FIG. 5C). Further, the indoor thermal capacity $C_Z$ varies with the magnitude of the indoor volume to be modelled.

If it is possible to estimate the indoor volume based on the floor area set by the user, the upper and lower parameter limit setting unit 323*a* calculates the initial value of the indoor thermal capacity $C_Z$ by multiplying the estimated indoor volume V [$m^3$] by the physical property value of air ρC [kJ/(kg·K)]. If an evaluated floor is an office, the upper and lower parameter limit setting unit 323*a* may add the thermal capacities of furniture and fixtures as well as books to the indoor thermal capacity $C_Z$ to be estimated.

If floor area information is not registered in building information, the upper and lower parameter limit setting unit 323*a* may estimate the floor area or indoor volume from information on the rated capacity of the air-conditioning unit 21, which is included in device information. For example, it is possible to calculate the floor area by dividing the rated capacity of the air-conditioning unit 21 [W] by the maximum cooling load per floor area (e.g., 230 W/$m^2$). The maximum cooling load per floor area may be determined from design specifications, or may be determined from a common index that serves as a reference.

As for the thermal resistance of a wall, for example, the upper and lower parameter limit setting unit 323*a* calculates the initial value of the thermal resistance of a wall by multiplying the surface area of the wall by a coefficient of overall heat transmission. In the case of a building model that does not separate the roof, the floor, and the exterior wall but regards these structural components as a single frame, the surface area of a wall is calculated as follows: "squared root of estimated floor area"×4×"estimated ceiling height". Assuming that the surface area of a wall represents the exterior wall area, and the area of the ceiling equates to the estimated floor area, it is possible to estimate the surface area of the building frame by summing the exterior wall area, the floor area, and the ceiling area. The coefficient of overall heat transmission may be determined from design specifications, or may be determined from a common index based on the structure of the building.

The above-mentioned values such as the maximum cooling load and the coefficient of overall heat transmission merely serve as indices used in determining the upper and lower limits and initial value of a parameter. As such, high accuracy is not strictly required for these values.

The upper and lower parameter limit setting unit 323*a* determines the initial value of each parameter calculated as described above as a provisional estimate, and determines the upper and lower limits for each parameter. One exemplary method for determining the upper and lower limits is to normalize the initial values of individual parameters to variables with a mean of zero and a variance of 1, and determine, as the upper and lower limits, the maximum and minimum values within a range of ±3σ (σ: standard deviation) with respect to the mean of the normalized variables.

(Parameter Evaluation Unit 323*b*)

The parameter evaluation unit 323*b* evaluates whether an estimated value of a parameter has a noticeable influence on the output data of a building model. An example of this evaluation method will be described below. The parameter evaluation unit 323*b* performs a test that stochastically evaluates, for each parameter, whether increasing the value of the parameter increases the accuracy of output data estimation. Parameters determined to have a p-value of 0.05 or less as a result of the test are regarded as having an effect on the output data at the 5% significance level. Examples of tests used in this case include the t-test and the likelihood ratio test.

If the variation of each parameter Par (dF/dPar) with respect to the variation of an objective function F is close to zero, this indicates that the parameter has converged near the optimal solution of the objective function. Examples of the objective functions F include the sum of squared residuals between observed and estimated values, and the likelihood function.

If the objective function F is the sum of squared residuals between observed and estimated values, the parameter evaluation unit 323*b* calculates a parameter estimate in such a way that minimizes the sum of squared residuals between observed and estimated values. If the objective function F is the likelihood function, the parameter evaluation unit 323*b* calculates a parameter estimate in such a way that maximizes the likelihood of the building model.

If the value of the above-mentioned variation (dF/dPar) is sufficiently greater than zero, it is possible that the calculated parameter estimate has reached the upper or lower limit, and the search has ended without the optimal solution for the objective function being successfully reached. If the parameter estimate has reached the upper or lower limit, the parameter evaluation unit 323*b* resets the upper and lower limits for the parameter, and estimates the value of the parameter again. In one exemplary method for resetting the upper and lower limits for a parameter, the upper or lower limit for the parameter previously set based on statistics is relaxed by 10%.

(Model Evaluation Unit 324)

The model evaluation unit 324 determines a determined building model based on relative statistical values and residual evaluation results of the building models determined by the parameter estimation unit 323. An increase in the number of parameters in this building model tends to result in an increase in logarithmic likelihood. Accordingly, when selecting the best model by comparing models, the model evaluation unit 324 checks the significant difference either by comparing different models based on standardized indices such as Akaike's information criterion (AIC) and Takeuchi's information criterion (TIC), or by performing a test on logarithmic likelihood between different models. By checking the significant difference between different models, the model evaluation unit 324 is able to select a low-dimensional model that minimizes unnecessary increases in the number of parameters.

FIG. 8 is a table illustrating an example of statistical values on various models used by the model evaluation unit illustrated in FIG. 3. The table of FIG. 8 illustrates the logarithmic likelihood and the p-value used in a test for each of a plurality of different building models. It is assumed in this case that Models A to D in FIG. 8 respectively correspond to the thermal characteristic models illustrated in FIGS. 5A to 5D.

Now, with reference to FIG. 8, it is determined by means of a likelihood ratio test whether increasing model complexity from Models A to D brings about a significant difference in model's estimation accuracy (i.e., logarithmic likelihood). If the p-value is equal to or greater than 0.05, then it is not possible to say that there is a difference in logarithmic likelihood between two models compared at the 5% significance level. Accordingly, although the logarithmic likelihood is steadily increasing from Models A to D in FIG. 8, it is not possible to say that there is a significant difference in logarithmic likelihood between Model C and Model D. In the example illustrated in FIG. 8, although the logarithmic likelihood of Model D is greater than the logarithmic likelihood of Model C, the model evaluation unit 324 selects Model C, which has a p-value of less than 0.05, as an optimal model.

Further, as will be described below, the model-residual evaluation unit 324*a* determines the final determined building model based on the above-mentioned evaluation results.

(Model-residual Evaluation Unit 324*a*)

In evaluating the estimation accuracy of a model, it is important to evaluate not only the sum of squared residuals between observed and estimated values of the output data of an estimated model or the likelihood of an estimated model but also the statistical properties of the residual of the output data. If a good approximation of output data has been obtained with respect to input data, the residual is white noise. White noise refers to noise having equal intensity across all frequencies and having no correlation with past data, that is, having no autocorrelation. Whether noise has equal intensity across all frequencies can be assessed by calculating a periodogram represented by Eq. (4).

[Eq. 4]

$$p(f) = C_0 + 2\sum_{k=1}^{N-1} C_k \cos 2\pi kf \tag{4}$$

In Eq. (4), f denotes frequency [Hz], C denotes autocovariance function [−], k denotes time lag [−], and N denotes the number of pieces of data [−].

Figure 9:
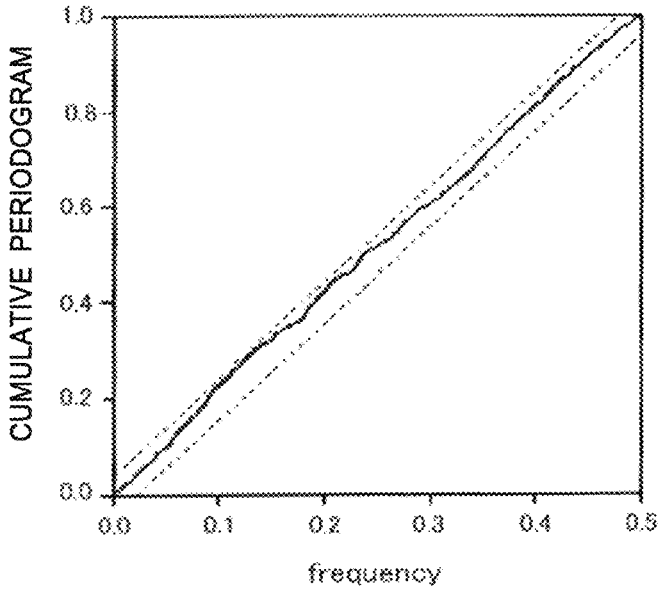
FIG. 9 is a graph illustrating an exemplary cumulative periodogram used by a model-residual evaluation unit illustrated in FIG. 3.

FIG. 9 illustrates an exemplary cumulative periodogram used by the model-residual evaluation unit illustrated in FIG. 3. The graph of FIG. 9 illustrates a cumulative periodogram representing an accumulation of periodogram for each individual frequency. The horizontal axis of the graph illustrated in FIG. 9 represents frequency, and the vertical axis represents the value of cumulative periodogram with respect to frequency. In FIG. 9, the interval bounded by two dashed lines represents a 95% confidence interval. As illustrated in FIG. 9, it can be appreciated that if the cumulative periodogram falls within the 95% confidence interval bounded by two dashed lines across all frequencies, the intensity is uniform across all frequencies.

An assessment for the presence of autocorrelation can be made by using an autocorrelation function (ACF) at varying time lags. The autocorrelation function can be calculated by Eq. (5).

[Eq. 5]

$$ACF(k) = \frac{\sum_{t=k+1}^{N} (y_t - \mu)(y_{t-k} - \mu)}{\sum_{t=1}^{N} (y_t - \mu)^2} \tag{5}$$

In Eq. (5), y denotes residual [−], μ denotes mean residual [−], and k denotes time lag [−]. An autocorrelation function is also referred to as autocorrelation coefficient in some cases.

FIG. 10 is a graph illustrating an exemplary autocorrelation coefficient used by the model-residual evaluation unit illustrated in FIG. 3. The horizontal axis of the graph illustrated in FIG. 10 represents time lag, and the vertical axis represents ACF. In FIG. 10, time lag is abbreviated as "lag". The interval bounded by two dashed lines in FIG. 10 represents a 95% confidence interval, which indicates that the autocorrelation coefficient significantly differs from zero if the autocorrelation coefficient does not fall within this interval.

As illustrated in FIG. 10, if the ACF does not depend on time lag, that is, if the ACF falls within the 95% confidence interval indicated by the dashed lines in FIG. 10, then the model-residual evaluation unit 324*a* determines that there is no autocorrelation in the residual. This residual evaluation corresponds to evaluation of the sensitivity of input and output data for a building model.

After selecting one building model as a determined building model based on the p-value as illustrated in FIG. 8, the model-residual evaluation unit 324*a* performs residual evaluation. If the model-residual evaluation unit 324*a* is able to determine that the residual is white noise, the model-residual evaluation unit 324*a* determines the corresponding building model as an optimal model for a determined building model. If the model-residual evaluation unit 324*a* is unable to determine that the residual is white noise, the model-residual evaluation unit 324*a* excludes the corresponding building model from candidate models to be selected, and selects one building model as a candidate determined building model from the remaining building models. For example, from among the remaining models, the model-residual evaluation unit 324*a* either selects the model with the minimum AIC or TIC as the next candidate, or re-calculates the p-value by a test and selects the model with the minimum p-value as the next candidate.

If the model-residual evaluation unit 324*a* is unable to determine for all candidate models that the residual is white noise, the model-residual evaluation unit 324*a* relaxes the confidence interval from 95% to 90%, and then performs evaluation in the same manner as described above to select a candidate determined building model. If it is not possible to determine that the residual is white noise for all candidate models even if the confidence interval is relaxed to 90%, the model-residual evaluation unit 324*a* selects the model with the minimum degree of departure from the 90% confidence interval of the cumulative periodogram as an optimal model. The degree of departure is defined as the maximum value of the difference between the cumulative periodogram for each frequency and the 90% confidence interval.

(Air-Conditioning Control Evaluation Unit 325)

The air-conditioning control evaluation unit 325 uses a determined building model to calculate the values of thermal load, room temperature, indoor humidity, and power consumption of the air-conditioning system that result if an air-conditioning control included in a set of air-conditioning controls is performed.

The energy-saving evaluation unit 325*a* calculates the following values as energy-saving evaluation values: the amount by which power consumption changes, relative to the power consumption that results if a given evaluated air-conditioning control is performed, if another evaluated air-conditioning control is performed, and the change represented as a ratio.

The comfort evaluation unit 325*b* calculates the following values as comfort evaluation values: the amount by which room temperature and indoor humidity change, relative to the room temperature and indoor humidity that result if a given evaluated air-conditioning control is performed, if another evaluated air-conditioning control is performed, and the change represented as a ratio. The comfort evaluation unit 325*b* may use a PMV value, which is an index of comfort, as a comfort evaluation value.

The air-conditioning control evaluation unit 325 stores the calculated energy-saving and comfort evaluation values into the storage unit 31.

(Data Input Unit 33)

The data input unit 33 has the function of communicating with the air-conditioning unit 21. Upon receiving operational data and measured data from the air-conditioning unit 21, the data input unit 33 stores the operational data and the measured data into the storage unit 31. The data input unit 33 may, for example, download a file containing building information and device information from an information processing apparatus (not illustrated) via the general-purpose network 16 illustrated in FIG. 2, and store the downloaded file into the storage unit 31. An air-conditioning control to be evaluated is specified via the data input unit 33. The data input unit 33 acquires various data on the air-conditioning unit 21 from the air-conditioning unit 21 via a communication medium. The type of the communication medium is not particularly limited. For example, the communication medium may be either a wired medium or a wireless medium.

The data input unit 33 may be a touch panel mounted on a display device. If the data input unit 33 is a touch panel, the user may directly enter building information and device information via the touch panel.

Further, the user may freely select a model from a set of pre-stored building models via the data input unit 33.

(Data Output Unit 34)

The data output unit 34 is, for example, an output device including a display and a printer.

The data output unit 34 reads and outputs energy-saving and comfort evaluation values stored in the storage unit 31. If the data output unit 34 is a display, the data output unit 34 displays, on a screen, evaluation values including the energy-saving and comfort evaluation values. The user is thus able to check the effect of an evaluated air-conditioning control on energy saving and comfort by looking at the evaluation values displayed on the screen.

The data output unit 34 may display one or both of a set of building models and a determined building model that are stored in the storage unit 31. The building model to be displayed in this case may be one of the thermal network models as illustrated in FIGS. 5A to 5G and the humidity characteristic models as illustrated in FIGS. 7A and 7B, or may be in the form of listing of factors that are considered for one or both of thermal characteristics and humidity characteristics for each building model. The user is thus able to check what kinds of building models are stored in advance, or whether a building model suited for each floor or a building model suited for both each floor and each area of interest has been selected as a determined building model.

(Operation Procedure for Air-Conditioning Control Evaluation Apparatus 3)

Next, an operation procedure for the air-conditioning control evaluation apparatus 3 according to Embodiment 1 will be described.

Figure 11:
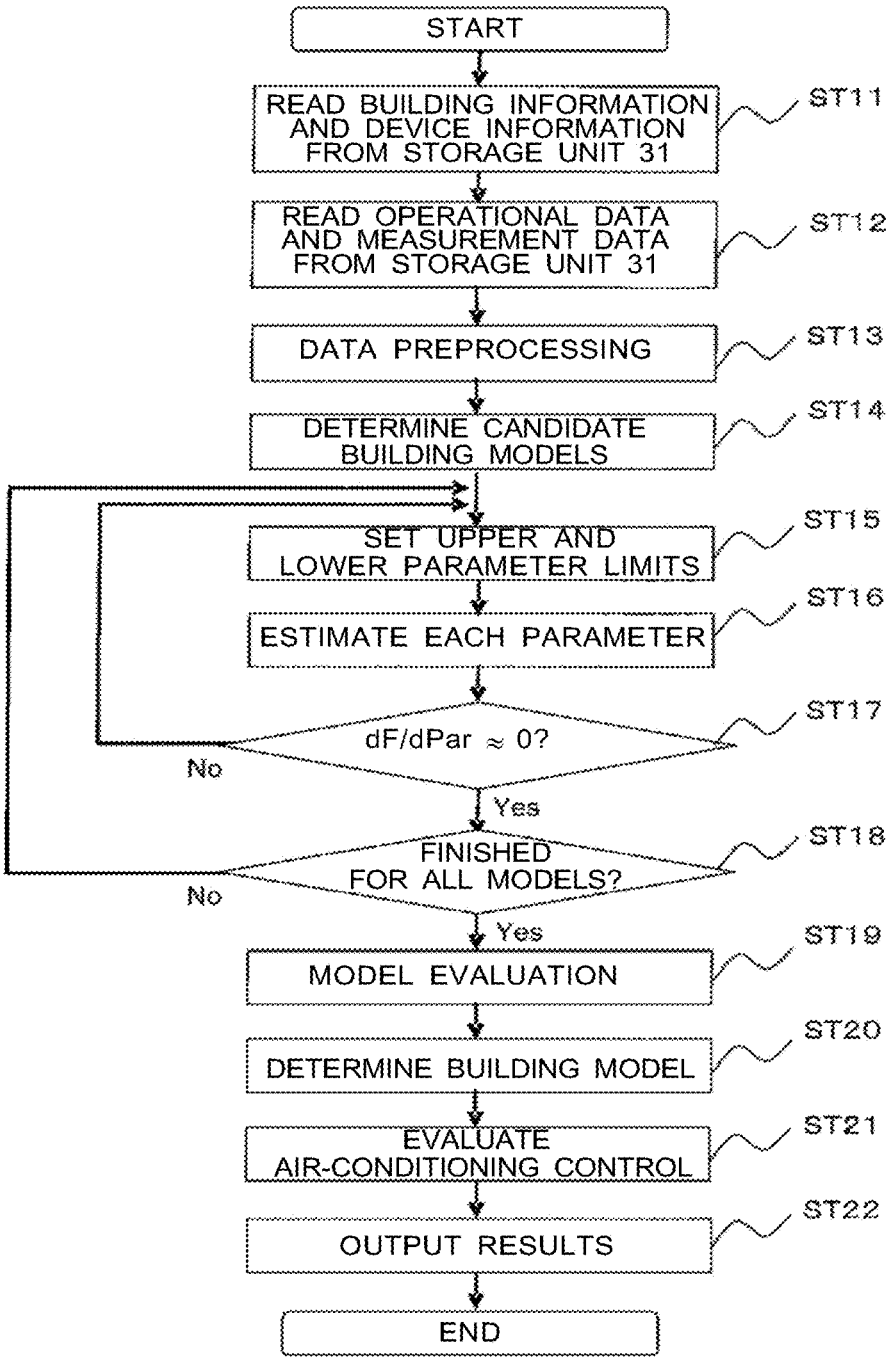
FIG. 11 is a flowchart illustrating an operational procedure for the air-conditioning control evaluation apparatus according to Embodiment 1 of the present invention.

FIG. 11 is a flowchart illustrating an operation procedure for the air-conditioning control evaluation apparatus according to Embodiment 1 of the present invention. This procedure is executed at predetermined time intervals, such as one [time/day]. The intervals of one [time/day] mentioned above are merely exemplary, and the intervals may be one [time/ week] or one [time/week]. This time interval information is included in building information or device information, and stored in the storage unit 31. The details of processing in each step have been described above with reference to the functions of various units of the computing unit 32, and thus will not be repeated in the following description.

As illustrated in FIG. 11, when an air-conditioning control to be evaluated is specified, the computing unit 32 reads building information and device information from the storage unit 31 (step ST11), and reads operational data and measured data on the air-conditioning related device 12 from the storage unit 31 (step ST12). Subsequently, the computing unit 32 performs data preprocessing on the information read at step ST11 and step ST12 (step ST13). In the data preprocessing, the computing unit 32 determines which item is available as input data for a building model among items included in the device information, device-related information including the operational data and the measured data, and the building information, and identifies the type of the distribution of the observed data including the operational data and the measured data.

At step ST14, the computing unit 32 determines a plurality of candidate building models, based on an item available as input data for the building model and the candidate-model selection criterion 311 stored in the storage unit 31. Then, the computing unit 32 determines the upper and lower limits and initial value for each parameter in the plurality of candidate building models (step ST15). Subsequently, the computing unit 32 uses a parameter estimation method corresponding to the type of distribution identified at step ST13 to estimate each parameter in the plurality of candidate building models (step ST16). Further, the computing unit 32 evaluates each parameter estimate, and determines whether the parameter estimate has converged near the optimal solution (step ST17).

The computing unit 32 determines whether steps ST15 to 17 have been finished for all of the candidate building models determined at step ST14 (step ST18). If it is determined at step ST18 that parameter estimates have converged for all of the candidate building models, the computing unit 32 determines the significant difference between the plurality of candidate building models, and uses residuals obtained for individual building models to evaluate the sensitivity of input and output data (step ST19).

The computing unit 32 determines an optimal building model based on the determination and evaluation performed at step ST19 (step ST20). The computing unit 32 uses the determined building model obtained at step ST20 to evaluate the levels of energy saving and comfort attained if the evaluated air-conditioning control is executed (step ST21). The computing unit 32 outputs the evaluation results obtained at step ST21 via the data output unit 34 (step ST22).

Although the foregoing description of the configuration and operation of the air-conditioning control evaluation apparatus 3 has focused on one air-conditioning unit 21, the air-conditioning control evaluation method executed by the air-conditioning control evaluation apparatus 3 can be applied to each of the plurality of air-conditioning units 21 illustrated in FIG. 3. For example, if a building of interest is a three-story building with the air-conditioning unit 21 disposed on each floor, then the air-conditioning control evaluation apparatus 3 may select a building model corresponding to each floor.

Although the foregoing description of the configuration and operation of the air-conditioning control evaluation apparatus 3 is directed to a case in which, among the components of the air-conditioning related device 12 illustrated in FIG. 1A, the air-conditioning unit 21 is the device to be controlled, the device to be controlled is not limited to the air-conditioning unit 21. Further, the device to be controlled may not necessarily be one of the components of the air-conditioning related device 12 illustrated in FIG. 1A but a plurality of components may serve as devices to be controlled.

As described above, in Embodiment 1, the air-conditioning control evaluation apparatus determines which item is available as input data, from among items included in building information, which is information related to a building including an area for which the condition of air is to be evaluated, device information, which includes the characteristics of an air-conditioning related device whose power consumption is to be evaluated, and observed data including temperature and humidity. The air-conditioning control evaluation apparatus selects a plurality of building models based on the results of the determination and the candidate-model selection criterion, calculates predetermined statistics on the plurality of selected building models, obtains an estimated value for each parameter in each building model in accordance with a parameter estimation method corresponding to the type of distribution of the observed data of the air-conditioning related device, and determines one building model based on the statistics and the residual between estimated and observed values calculated for each building model. As a result, a building model is selected in correspondence with the building where the air-conditioning related device is disposed, and each parameter in the building model is estimated based on the type of distribution of the observed data. Accordingly, in correspondence with the building where the air-conditioning related device subject to evaluation is disposed, the corresponding thermal load of the building can be estimated with high accuracy, thus making it possible to evaluate energy saving and indoor comfort for an evaluated air-conditioning control.

Further, for a plurality of building models, the models are compared with each other by using statistics. This helps minimize the number of parameters necessary for estimating the variation of the power consumption of the air-conditioning related device as well as changes in indoor comfort.

Examples of control methods to achieve energy saving for an air-conditioning system include, other than simply raising or lowering the temperature setting of the air-conditioning related device, optimally combining the activation and deactivation of the air-conditioning related device, and operating the air-conditioning apparatus under a condition in which energy saving is achieved due to the characteristics of the air-conditioning related device. These control methods place priority on energy saving, and do not take changes in indoor comfort into consideration.

If the air-conditioning control evaluation apparatus according to Embodiment 1 is used to execute evaluation of these control methods, the user is able to check how indoor comfort will change, prior to actually introducing these control methods to the air-conditioning system.

For a control that attempts to achieve energy saving by forcibly deactivating an air-conditioning unit in an area within a building, the air-conditioning control evaluation apparatus according to Embodiment 1 may be made to evaluate the control in advance. In this case, how much the room temperature of the area of interest will vary while the air-conditioning unit is in deactivated condition can be evaluated in advance. As a result, based on the evaluation results, it is possible to determine the time for which the air-conditioning unit is to be deactivated, or change the area for which the air-conditioning unit is to be deactivated to a different area.

As a method to evaluate an air-conditioning control for a space within a building, it would be conceivable to use a regression model in which each objective variable is represented by the sum of the products of an explanatory variable and regression coefficients. Such a regression model has the advantage of enabling automatic selection of explanatory variables that have high correlation with each objective variable and also avoid multicollinearity. However, if the thermal load of a building as well as indoor temperature and humidity are the objective variables, using correlation coefficients alone would be inadequate in selecting explanatory variables, because factors such as building geometry and sensor location that do not appear in the correlation between data also have influence.

There is also a possibility that, to avoid multicollinearity, physically important input data is deleted due to apparent correlation of data despite the absence of actual correlation. As a result, even if the output data of the model to be used can be estimated with improved accuracy, it is not possible to appropriately model how the output data varies as input data is varied. This potentially deteriorates the accuracy of estimation of the effect of an energy-saving control.

In one possible configuration of Embodiment 1, the set of building models includes a thermal characteristic model, or both the thermal characteristic model and a humidity characteristic model. The thermal characteristic model, which includes at least outside air temperature and indoor heat generation rate as factors influencing thermal characteristics, includes a thermal characteristic model including a parameter representing the heat insulation performance of the frame of the building, and a thermal characteristic model including a parameter representing the heat insulation performance and heat storage performance of the frame of the building. The humidity characteristic model represents a moisture balance including, as factors influencing humidity characteristics, at least outside-air humidity, rate of moisture generation in the area, dehumidification rate during cooling of the air-conditioning related device, and rate of moisture absorption and desorption by a structural object defining the area. In this case, a building model approximated by one or both of thermal characteristics and humidity characteristics can be selected for a building for which an evaluated air-conditioning control is performed.

In accordance with Embodiment 1, the parameter estimation unit may determine an estimated value for a parameter within a range bounded by the upper and lower limits of the parameter, such that the sum of squared residuals between the observed and estimated values of the parameter is minimized or such that the likelihood of each of the plurality of selected candidate building models is maximized. Accordingly, if the observed data follows a normal distribution, the parameter estimation unit calculates an estimated value in such a way that minimizes the sum of squared residuals between observed and estimated values, and if the observed data does not follow a normal distribution, the parameter estimation unit calculates an estimated value in such a way that maximizes the likelihood of each building model. This helps improve the accuracy of the estimated parameter value.

In one possible configuration of Embodiment 1, a given reference control is selected for the air-conditioning related device, and the amount by which power consumption changes if an evaluated air-conditioning control is performed, relative to the reference control, is calculated as an energy-saving evaluation value. One example of such a reference control is a control to keep constant set temperature, which is carried out on a daily routine basis. This provides a better indication of how much energy saving is possible. In another possible configuration, a given control is selected for the air-conditioning related device, and the amount by which each of indoor temperature and indoor humidity changes if an evaluated control is executed, relative to the reference control, is calculated as a comfort evaluation value. This provides a better indication of how indoor comfort has changed.

In one possible configuration of Embodiment 1, if the building has a plurality of floors, and the building information includes information indicating which floor the floor of the area including the location of the air-conditioning related device corresponds to among the plurality of floors, the candidate-model selection criterion defines which candidate building model is to be selected, in correspondence with the information indicating which floor the air-conditioning related device is disposed. This allows for selection of a building model better suited for the floor on which the related device is disposed, thus improving the accuracy with which energy-saving and comfort evaluation values are estimated.

In one possible configuration of Embodiment 1, the building information includes information indicating whether a humidifier is disposed within the area, and the candidate-model selection criterion defines which candidate building model is to be selected, in correspondence with the information indicating whether a humidifier is disposed within the area and information on availability as input data. This enables a more optimal building model to be selected for a building including the area subject to an evaluated air-conditioning control, in accordance with whether a humidifier is disposed within the area.

In another possible configuration of Embodiment 1, the device information includes information on the location where the air-conditioning related device is disposed within the area, the building information includes information on the location where a sensor is disposed to measure temperature within the area, the observed data includes one or both of suction temperature data measured by a sensor disposed in the air-conditioning related device and room temperature data measured by the sensor disposed within the area, and the candidate-model selection criterion defines which candidate building model is to be selected, in correspondence with the location where the air-conditioning related device is disposed. This enables a more optimal building model to be selected for a building including the area subject to an evaluated air-conditioning control, in accordance with the location where the air-conditioning related device is disposed within the area and the location where the temperature sensor is disposed within the area. Further, the value of each parameter can be estimated with improved accuracy in correspondence with the selected building model and one or both of the suction temperature data indicative of the temperature of suction by the air-conditioning related device and the room temperature data measured by the temperature sensor.

In one further possible configuration of Embodiment 1, the cumulative periodogram of the residual and the autocorrelation coefficient of the residual are calculated for each building model, and it is determined, based on the cumulative periodogram and the autocorrelation coefficient, whether the residual is white noise. If the residual is determined to be white noise, the building model that minimizes the residual is selected as an optimal model. This improves the accuracy with which energy-saving and comfort evaluation values are estimated.

Embodiment 2

Embodiment 2 makes it possible to execute, for an air-conditioning unit, an evaluated control that has been selected by the user.

The configuration of the air-conditioning control evaluation apparatus according to Embodiment 2 will be described. Features of the configuration different from those of Embodiment 1 will be described in detail below, and features similar to those of Embodiment 1 will not be described in further detail.

Figure 12:
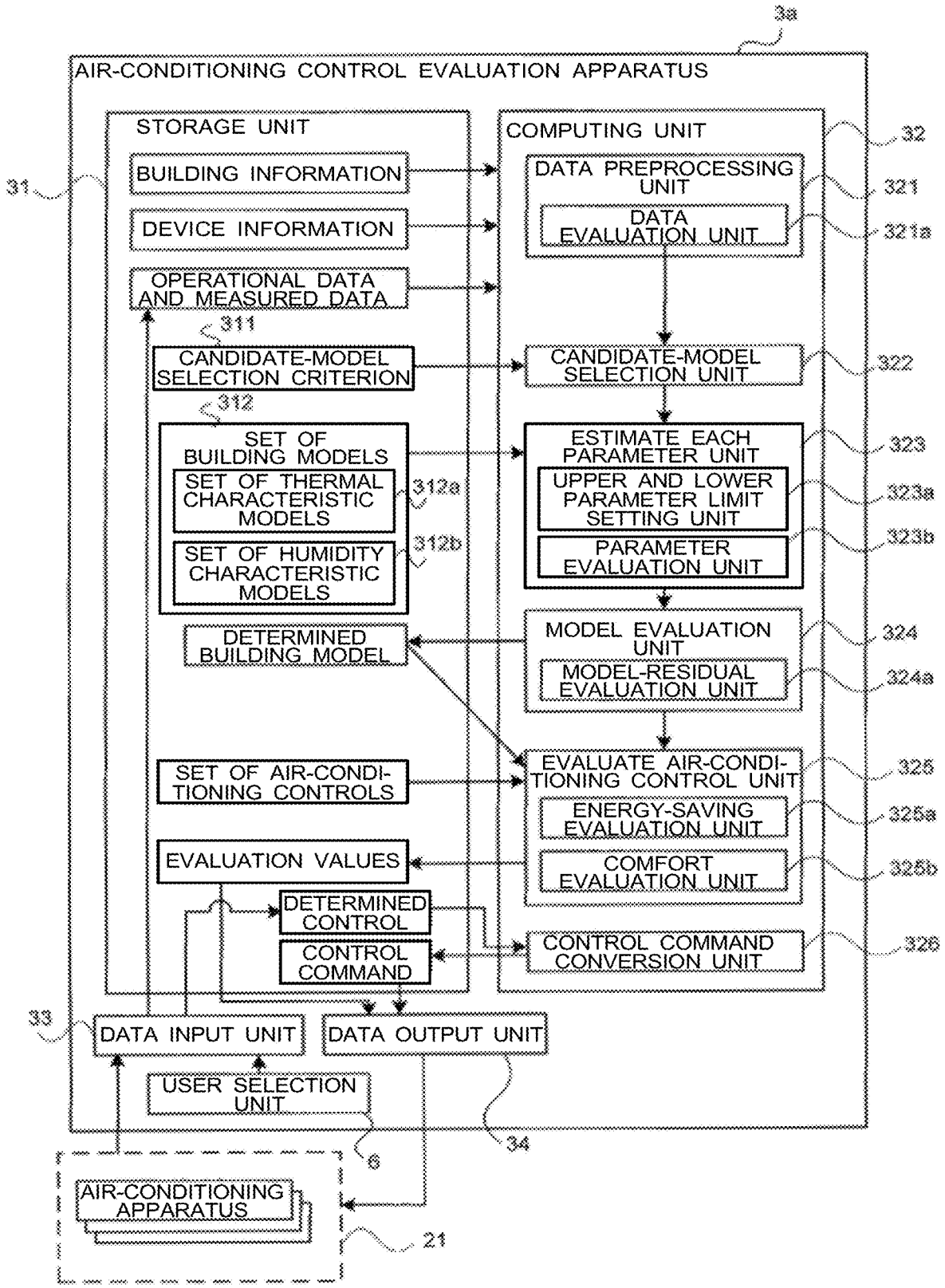
FIG. 12 is a block diagram illustrating one exemplary configuration of an air-conditioning control evaluation apparatus according to Embodiment 2 of the present invention.

FIG. 12 is a block diagram illustrating an exemplary configuration of an air-conditioning control evaluation apparatus according to Embodiment 2 of the present invention. As illustrated in FIG. 12, an air-conditioning control evaluation apparatus 3*a* includes a user selection unit 6 and a control command conversion unit 326, in addition to the components illustrated in FIG. 3. The control command conversion unit 326 is provided in the computing unit 32.

The user selection unit 6 allows the user to select information representing an air-conditioning control to be executed by the air-conditioning unit 21 from among a set of air-conditioning controls. The user selection unit 6 temporarily stores information on a determined control, which includes the information on the air-conditioning control selected by the user into the storage unit 31, and subsequently transmits a signal indicative of the determined control to the control command conversion unit 326.

Although FIG. 12 depicts the user selection unit 6 and the data input unit 33 as separate components, the data input unit 33 may include the function of the user selection unit 6.

The control command conversion unit 326 is implemented in the air-conditioning control evaluation apparatus 3*a* when a CPU (not illustrated) executes a program. When the control command conversion unit 326 receives a signal indicative of a determined control from the user selection unit 6 via the storage unit 31, the control command conversion unit 326 converts the air-conditioning control included in the signal indicative of a determined control into a control command that is to be executed by the air-conditioning unit 21. The control command conversion unit 326 transmits the control command to the air-conditioning unit 21 via the data output unit 34.

The data output unit 34 has the function of communicating with the air-conditioning unit 21. The data output unit 34 reads out a control command stored in the storage unit 31, and transmits the control command to the air-conditioning unit 21. There is no particular limitation on the type of the communication medium used by the data output unit 34 to transmit the control command to the air-conditioning unit 21. The communication medium may be, for example, either a wired or wireless communication medium. The means of communication used between the air-conditioning unit 21 and the data input unit 33, and the means of communication used between the air-conditioning unit 21 and the data output unit 34 may be different. That is, these communication means may be a combination of a plurality of types of communication means.

Next, an operation procedure for the air-conditioning control evaluation apparatus according to Embodiment 2 will be described.

Figure 13:
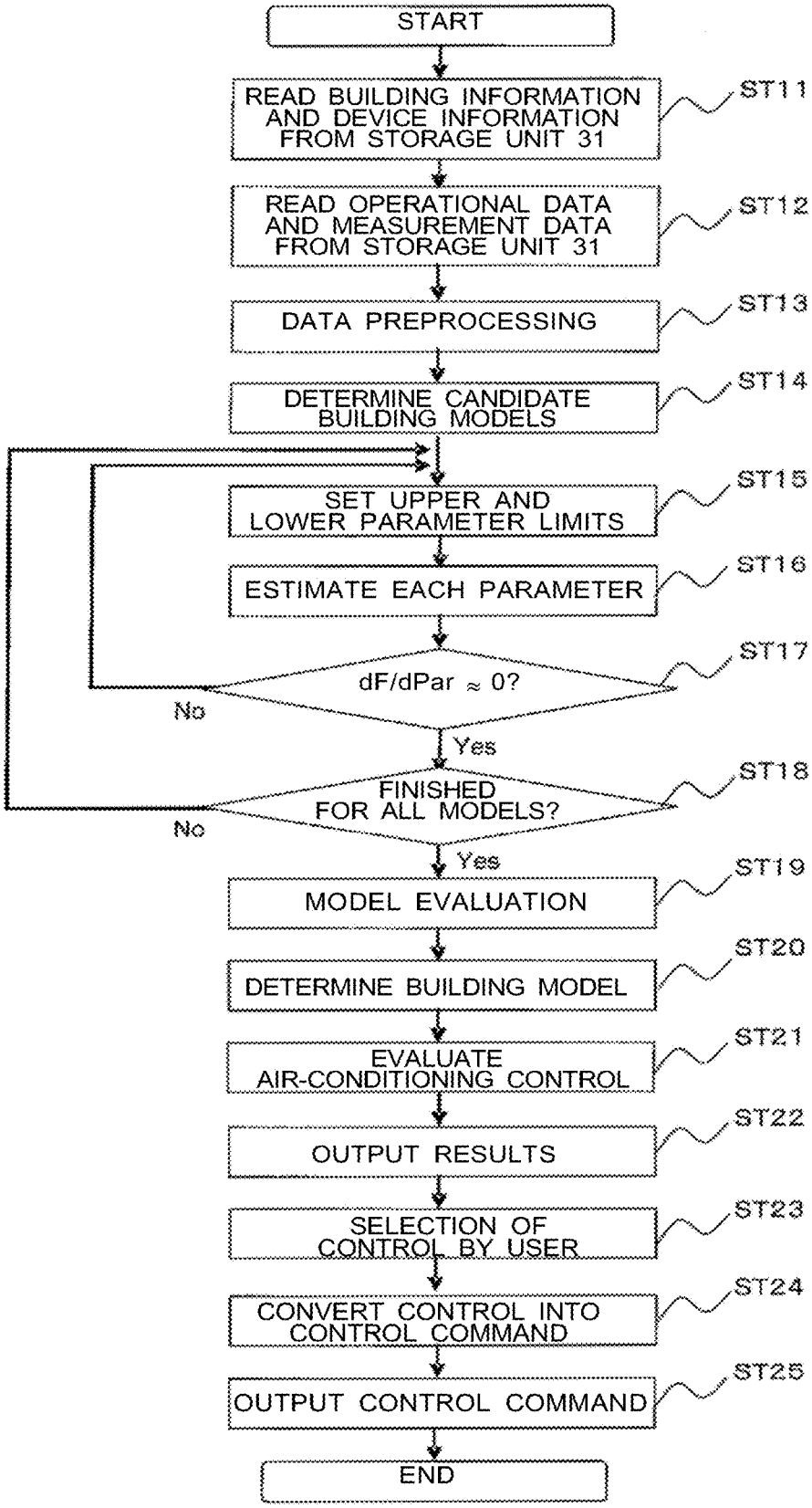
FIG. 13 is a flowchart illustrating an operational procedure for the air-conditioning control evaluation apparatus according to Embodiment 2 of the present invention.

FIG. 13 is a flowchart illustrating an operation procedure for the air-conditioning control evaluation apparatus according to Embodiment 2 of the present invention. The following description of Embodiment 2 will be directed to steps ST23 to ST25 added to the operational procedure illustrated in FIG. 11, and steps ST11 to ST22 will not be described in further detail.

After step ST22, based on the evaluation results output by the data output unit 34, the user operates the user selection unit 6 to select an air-conditioning control that the user desires to evaluate from a set of air-conditioning controls. Upon recognizing that an air-conditioning control has been selected by the user (step ST23), the computing unit 32 generates, based on the selected air-conditioning control, a command control that is to be transmitted to the air-conditioning unit 21 (step ST24). Subsequently, the computing unit 32 transmits the generated control command to the air-conditioning unit 21 via the data output unit 34 (step ST25).

Embodiment 2 not only provides the same effect as Embodiment 1 but also enables an air-conditioning control selected by the user to be actually executed by the air-conditioning system under evaluation.

Embodiment 3

Embodiment 3 enables contaminant concentration to be also taken into account as a comfort evaluation value. Embodiment 3 additionally takes contaminant concentration into account in evaluating indoor comfort for cases where the device under evaluation includes not only the air-conditioning unit 21 but also units involved in the removal of indoor contaminants, such as the ventilator 22 and the outdoor-air handling unit 27 illustrated in FIG. 1A.

The configuration of the air-conditioning control evaluation apparatus according to Embodiment 3 will be described below. Features of the configuration different from those of Embodiment 1 will be described in detail below, and features similar to those of Embodiment 1 will not be described in further detail.

Figure 14:
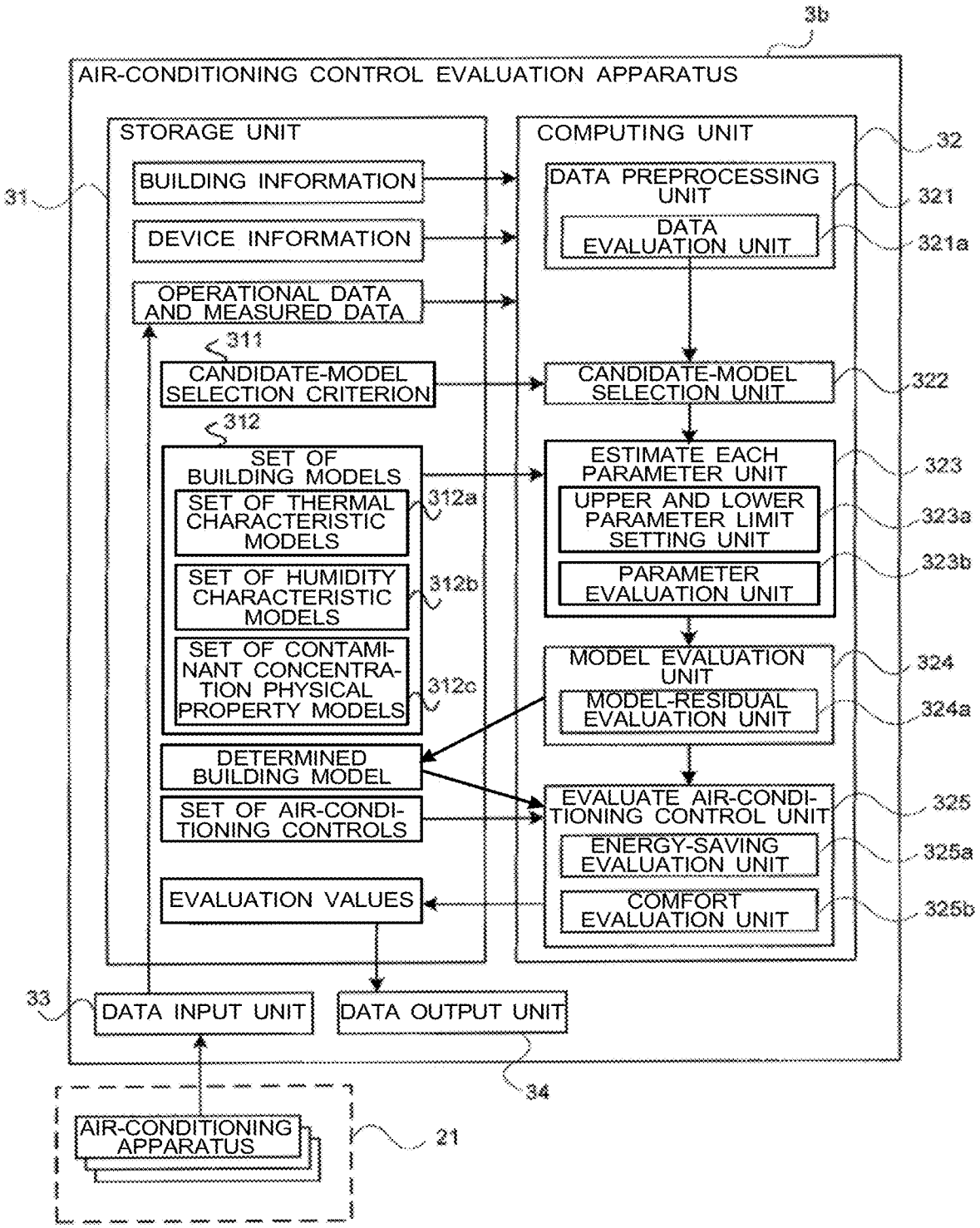
FIG. 14 is a block diagram illustrating one exemplary configuration of an air-conditioning control evaluation apparatus according to Embodiment 3 of the present invention.

FIG. 14 is a block diagram illustrating an exemplary configuration of an air-conditioning control evaluation apparatus according to Embodiment 3 of the present invention. As illustrated in FIG. 14, an air-conditioning control evaluation apparatus 3*b* is configured such that the set of building models 312 illustrated in FIG. 3 further includes a set of contaminant concentration characteristic models 312*c*. The set of contaminant concentration characteristic models 312*c* includes a plurality of types of contaminant concentration characteristic models corresponding to the characteristics of changes in contaminant.

An example of a contaminant concentration characteristic model is an indoor $CO_2$ concentration characteristic model. The contaminant concentration characteristic model is not limited to a $CO_2$ concentration characteristic model but may be any concentration characteristic model for a substance to be evaluated as an indoor contaminant, such as a volatile organic compound (VOC) or ozone. Eq. (6) represents an example of an indoor $CO_2$ concentration characteristic model.

[Eq. 6]

$$V_z \frac{d\rho_z}{dt} = (\rho_o - \rho_z)(G_{vent} + G_{draft}) + M_{OCC} \tag{6}$$

In Eq. (6), $\rho_0$ denotes outside-air $CO_2$ concentration [ppm], $G_{vent}$ denotes ventilation rate [$m^3$/h], $\rho_Z$ denotes indoor $CO_2$ concentration [ppm], $G_{draft}$ denote draft airflow rate [$m^3$/h], $V_Z$ denotes room volume [$m^3$], and $M_{OCC}$ denotes indoor $CO_2$ generation rate [$m^3$/h].

Eq. (6) can be varied in accordance with the location where indoor $CO_2$ concentration is measured. Eq. (6) represents a model for a case in which indoor $CO_2$ concentration is measured in an indoor living space. If indoor $CO_2$ concentration is measured at the air inlet of each of the ventilator 22 and the outdoor-air handling unit 27, this $CO_2$ concentration deviates from the $CO_2$ concentration measured in an indoor living space. Accordingly, the model can be changed to one that takes such a spatial and temporal deviation into account. If $CO_2$ concentration is measured both in an indoor living space and at the air inlet, then the model can be changed to one representing a set of simultaneous $CO_2$ concentration balance equations for the respective measurement points.

In Embodiment 3, the device information includes information on the location of a sensor disposed in the air-conditioning related device 12 to measure contaminant concentration. The building information includes information on the location of a sensor disposed to measure contaminant concentration within an area. The observed data includes one or both of contaminant concentration data measured by the sensor disposed in the air-conditioning related device 12 and contaminant concentration data measured by the sensor disposed within the area. The candidate-model selection criterion defines which candidate contaminant concentration characteristic model is to be selected, in correspondence with the information on the location of the sensor disposed to measure contaminant concentration within the area.

The building model selection criterion describes a selection criterion that associates a contaminant concentration characteristic model with each of the following information items: a measured value of contaminant concentration, time-series data on measured value, and the location of measurement.

If available items evaluated by the data evaluation unit 321*a* include an item related to contaminant concentration, the model evaluation unit 324 causes, based on the item and the above-mentioned selection criterion, information on a contaminant concentration characteristic model to be included in a determined building model.

The comfort evaluation unit 325*b* of the air-conditioning control evaluation unit 325 calculates the following value as a comfort evaluation value. That is, the comfort evaluation unit 325*b* calculates the amount by which indoor contaminant concentration changes, relative to the indoor contaminant concentration that results if at least one of a plurality of evaluated controls is executed for the air-conditioning unit 21, if another evaluated air-conditioning control is executed.

The foregoing description of Embodiment 3 is directed to a case in which the set of building models 312 includes a plurality of types of contaminant concentration characteristic models. However, if there is only one conceivable cause of contaminant generation given the mechanism of contaminant generation, then only one contaminant concentration characteristic model may be registered in the set of building models 312. The operation according to Embodiment 3 is similar to the operational procedure described above with reference to FIG. 11, and hence will not be described in further detail.

Embodiment 3 not only provides an effect similar to Embodiment 1 but also enables comfort to be evaluated for an evaluated control by taking indoor contaminant concentration into account. Although Embodiment 3 has been described above based on Embodiment 1, Embodiment 3 may be applied to Embodiment 2.

In one possible configuration of Embodiment 3, the device information includes information on the location of a sensor disposed in the air-conditioning related device to measure contaminant concentration, the building information includes information on the location of a sensor disposed to measure contaminant concentration within the area, the observed data includes one or both of contaminant concentration data measured by the sensor disposed in the air-conditioning related device and contaminant concentration data measured by the sensor disposed within the area, and the candidate-model selection criterion defines which candidate contaminant concentration characteristic model is to be selected, in correspondence with the information on the location of the sensor disposed to measure contaminant concentration within the area. In this case, for a building subject to an evaluated air-conditioning control, a more optimal contaminant concentration characteristic model can be selected in correspondence with the location of a sensor that measures contaminant concentration, and contaminant concentration can be estimated with improved accuracy in correspondence with the selected model and contaminant concentration data included in observed data.

To cause a computer to execute the air-conditioning control evaluation method described above with reference to each of Embodiments 1 to 3, a program describing the procedure for executing the method may be stored in a recording medium. A computer storing the program may provide the program via a network to an information processing apparatus such as another computer.

REFERENCE SIGNS LIST

1, 1*a* to 1*c* air-conditioning system 3, 3*a*, 3*b* air-conditioning control evaluation apparatus 6 user selection unit 11, 11*a* air-conditioning controller 12 air-conditioning related device 13 air-conditioning network 14 device-connection controller 15 evaluation calculator 16 general-purpose network 19 sensor 21 air-conditioning unit 21*a* outdoor unit 21*b* indoor unit 22 ventilator 23 total heat exchanger 24 humidifier 25 dehumidifier 26 heater 27 outdoor-air handling unit 31 storage unit 32 computing unit 33 data input unit 34 data output unit 41 outside air temperature 42 solar radiation rate 43 adjacent-room temperature 44 indoor temperature 45 rate of heat removal by air conditioning 46 indoor heat generation rate 51 outside-air absolute humidity 52 indoor moisture generation rate 53 dehumidification rate 54 indoor absolute humidity 55 surface absolute humidity 311 candidate-model selection criterion 312 set of building models 312*a* set of thermal characteristic models 312*b* set of humidity characteristic models 312*c* set of contaminant concentration characteristic models 321 data preprocessing unit 321*a* data evaluation unit 322 candidate-model selection unit 323 parameter estimation unit 323*a* upper and lower parameter limit setting unit 323*b* parameter evaluation unit 324 model evaluation unit 324*a* model-residual evaluation unit 325 air-conditioning control evaluation unit 325*a* energy-saving evaluation unit 325*b* comfort evaluation unit 326 control command conversion unit

The invention claimed is:

1. An air-conditioning control evaluation apparatus that evaluates a plurality of controls for at least one air-conditioning related device disposed within a building, the air-conditioning control evaluation apparatus comprising:

a storage unit to store building information on a building that includes an area where the air-conditioning related device is disposed, device information including characteristics of the air-conditioning related device, observed data including information on an operational state of the air-conditioning related device, and information on temperatures of the area and outside air, or information on both temperatures and humidities of the area and outside air, control information on an evaluated control to be executed for the air-conditioning related device, a set of building models including a plurality of building models, the plurality of building models representing thermal characteristics of the building or both thermal characteristics and humidity characteristics of the building, and a candidate-model selection criterion representing a correspondence between a building model, and items included in each of the building information, the device information, and the observed data;

a data evaluation unit to determine an item available as input data for the building model from among the items included in each of the building information, the device information, and the observed data, and identify a type of distribution of the observed data;

a candidate-model selection unit to select, based on the item available as the input data and the candidate-model selection criterion, a plurality of candidate building models from the set of building models;

a parameter estimation unit to determine a parameter estimation method in correspondence with the type of distribution, and calculate, in accordance with the parameter estimation method, an estimated value for a parameter included in the plurality of selected candidate building models;

a model evaluation unit to calculate a predetermined statistic on the plurality of selected candidate building models, and determine, based on the statistic and a residual calculated for each of the plurality of selected candidate building models, one building model from the plurality of selected candidate building models, the residual being a residual between estimated and observed values of temperature or a residual between estimated and observed values of both temperature and humidity; and an air-conditioning control evaluation unit to calculate, by using the building model determined by the model evaluation unit, an energy-saving evaluation value and a comfort evaluation value for the air-conditioning related device that result if each of the plurality of evaluated controls is executed.

2. The air-conditioning control evaluation apparatus of claim 1, wherein the set of building models includes a thermal characteristic model, or both the thermal characteristic model and a humidity characteristic model, wherein the thermal characteristic model includes at least outside air temperature and indoor heat generation rate as factors influencing thermal characteristics, the thermal characteristic model including a thermal characteristic model including a parameter representing heat insulation performance of a frame of the building, and a thermal characteristic model including a parameter representing heat insulation performance and heat storage performance of the frame of the building, and wherein the humidity characteristic model represents a moisture balance including, as factors influencing humidity characteristics, at least outside-air humidity, rate of moisture generation in the area, dehumidification rate during cooling of the air-conditioning related device, and rate of moisture absorption and desorption by a structural object defining the area.

3. The air-conditioning control evaluation apparatus of claim 1, wherein when calculating the estimated value for the parameter, the parameter estimation unit sets an upper limit, a lower limit, and an initial value for the parameter, and determines the estimated value for the parameter within a range bounded by the upper limit and the lower limit of the parameter, such that a sum of squared residuals between observed and estimated values of the parameter is minimized or such that a likelihood of each of the plurality of selected candidate building models is maximized.

4. The air-conditioning control evaluation apparatus of claim 1, wherein the energy-saving evaluation value is an amount by which power consumption changes, relative to power consumption that results if at least one of the plurality of evaluated controls is executed for the air-conditioning related device, if an other one of the plurality of evaluated controls is executed, and wherein the comfort evaluation value is an amount by which a temperature of the area changes, relative to an estimated value of a temperature of the area that results if at least one of the plurality of evaluated controls is executed for the air-conditioning related device, if an other one of the plurality of evaluated controls is executed, or the comfort evaluation value is an amount by which both a temperature and a humidity of the area change, relative to estimated values of both a temperature and a humidity of the area that result if at least one of the plurality of evaluated controls is executed for the air-conditioning related device, if an other one of the plurality of evaluated controls is executed.

5. The air-conditioning control evaluation apparatus of claim 1, wherein the building information includes information indicating which floor an evaluated floor corresponds to among a plurality of floors of a building having the plurality of floors, the evaluated floor being a floor of the area where the air-conditioning related device is disposed, and wherein the candidate-model selection criterion defines which candidate building model is to be selected, in correspondence with the information indicating which floor the evaluated floor corresponds to.

6. The air-conditioning control evaluation apparatus of claim 1, wherein the building information includes information indicating whether a humidifier is disposed within the area, and wherein the candidate-model selection criterion defines which candidate building model is to be selected, in correspondence with the information indicating whether a humidifier is disposed within the area and information on availability as input data.

7. The air-conditioning control evaluation apparatus of claim 1, wherein the device information includes information on a location where the air-conditioning related device is disposed within the area, wherein the building information includes information on a location where a sensor is disposed to measure temperature within the area, wherein the observed data includes one or both of suction temperature data and room temperature data, the suction temperature data being measured by a sensor disposed in the air-conditioning related device, the room temperature being measured by the sensor disposed within the area, and wherein the candidate-model selection criterion defines which candidate building model is to be selected, in correspondence with the location where the air-conditioning related device is disposed.

8. The air-conditioning control evaluation apparatus of claim 1, wherein the model evaluation unit calculates, for each of the building models, a cumulative periodogram of the residual and an autocorrelation coefficient of the residual, determines whether the residual is white noise based on the cumulative periodogram and the autocorrelation coefficient, and determines, as the one building model, a building model that minimizes the residual from among building models for which the residual is determined to be white noise.

9. The air-conditioning control evaluation apparatus of claim 1, wherein the set of building models includes a contaminant concentration characteristic model representing characteristics of a change in contaminant concentration within the area, and wherein as the comfort evaluation value, the air-conditioning control evaluation unit calculates an amount by which contaminant concentration within the area changes, relative to contaminant concentration within the area that results if at least one of the plurality of evaluated controls is executed for the air-conditioning related device, if an other one of the plurality of evaluated controls is executed.

10. The air-conditioning control evaluation apparatus of claim 1, wherein the device information includes information on location of a sensor disposed in the air-conditioning related device to measure contaminant concentration, wherein the building information includes information on location of a sensor disposed to measure contaminant concentration within the area, wherein the observed data includes one or both of contaminant concentration data measured by the sensor disposed in the air-conditioning related device and contaminant concentration data measured by the sensor disposed within the area, and wherein the candidate-model selection criterion defines which candidate contaminant concentration characteristic model is to be selected, in correspondence with the information on location of the sensor disposed to measure contaminant concentration within the area.

11. The air-conditioning control evaluation apparatus of claim 1, wherein the storage unit stores a set of air-conditioning controls for the air-conditioning related device, the set of air-conditioning controls including a plurality of pieces of the control information, wherein the air-conditioning control evaluation apparatus further comprises a user selection unit to enable a user to select the evaluated control from the set of air-conditioning controls, and a control command conversion unit to, when the evaluated control is selected by the user by operating the user selection unit, transmit a control command based on the evaluated control to the air-conditioning related device.

12. An air-conditioning control evaluation method executed by a computer, the computer evaluating a plurality of evaluated controls to be evaluated for at least one air-conditioning related device disposed within a building, the air-conditioning control evaluation method comprising:

storing, in a storage unit of the computer, building information on a building that includes an area where the air-conditioning related device is disposed, device information including characteristics of the air-conditioning related device, observed data including information on an operational state of the air-conditioning related device, and information on temperatures of the area and outside air, or information on both temperatures and humidities of the area and outside air, control information on an evaluated control to be executed for the air-conditioning related device, a set of building models including a plurality of building models, the plurality of building models representing thermal characteristics of the building or both thermal characteristics and humidity characteristics of the building, and a candidate-model selection criterion representing a correspondence between a building model, and items included in each of the building information, the device information, and the observed data;

determining an item available as input data for the building model from among the items included in each of the building information, the device information, and the observed data, and identifying a type of distribution of the observed data;

selecting, based on the item available as the input data and the candidate-model selection criterion, a plurality of candidate building models from the set of building models;

determining a parameter estimation method in correspondence with the type of distribution, and calculating, in accordance with the parameter estimation method, an estimated value for a parameter included in the plurality of selected candidate building models;

calculating a predetermined statistic on the plurality of selected candidate building models, and determining, based on the statistic and a residual calculated for each of the plurality of selected candidate building models, one building model from the plurality of selected candidate building models, the residual being a residual between estimated and observed values of temperature or a residual between estimated and observed values of both temperature and humidity; and calculating, by using the determined building model, an energy-saving evaluation value and a comfort evaluation value for the air-conditioning related device that result if the evaluated control is executed.

13. A non-transitory computer readable medium including a computer program for causing a computer to execute a process, the process comprising:

storing, in a storage unit of the computer, building information on a building that includes an area where at least one air-conditioning related device disposed within a building is located, device information including characteristics of the air-conditioning related device, observed data including information on an operational state of the air-conditioning related device, and information on temperatures of the area and outside air, or information on both temperatures and humidities of the area and outside air, control information on an evaluated control to be executed for the air-conditioning related device, a set of building models including a plurality of building models, the plurality of building models representing thermal characteristics of the building or both thermal characteristics and humidity characteristics of the building, and a candidate-model selection criterion representing a correspondence between a building model, and items included in each of the building information, the device information, and the observed data;

determining an item available as input data for the building model from among the items included in each of the building information, the device information, and the observed data, and identifying a type of distribution of the observed data;

selecting, based on the item available as the input data and the candidate-model selection criterion, a plurality of candidate building models from the set of building models;

determining a parameter estimation method in correspondence with the type of distribution, and calculating, in accordance with the parameter estimation method, an estimated value for a parameter included in the plurality of selected candidate building models;

calculating a predetermined statistic on the plurality of selected candidate building models, and determining, based on the statistic and a residual calculated for each of the plurality of selected candidate building models, one building model from the plurality of selected candidate building models, the residual being a residual between estimated and observed values of temperature or a residual between estimated and observed values of both temperature and humidity; and calculating, by using the determined building model, an energy-saving evaluation value and a comfort evaluation value for the air-conditioning related device that result if the evaluated control is executed.

* * * * *